US011051120B2

(12) United States Patent
Mochizuki et al.

(10) Patent No.: US 11,051,120 B2
(45) Date of Patent: Jun. 29, 2021

(54) INFORMATION PROCESSING APPARATUS, INFORMATION PROCESSING METHOD AND PROGRAM

(71) Applicant: Sony Corporation, Tokyo (JP)

(72) Inventors: Daisuke Mochizuki, Chiba (JP); Junko Fukuda, Tokyo (JP); Tomohiko Gotoh, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/633,592

(22) PCT Filed: Jul. 17, 2018

(86) PCT No.: PCT/JP2018/026655
§ 371 (c)(1),
(2) Date: Jan. 24, 2020

(87) PCT Pub. No.: WO2019/026597
PCT Pub. Date: Feb. 7, 2019

(65) Prior Publication Data

US 2020/0221245 A1 Jul. 9, 2020

(30) Foreign Application Priority Data

Jul. 31, 2017 (JP) ..... JP2017-147722

(51) Int. Cl.
*H04S 7/00* (2006.01)
*H04R 3/12* (2006.01)
(Continued)

(52) U.S. Cl.
CPC ..... *H04S 7/303* (2013.01); *H04R 1/025* (2013.01); *H04R 1/403* (2013.01); *H04R 3/12* (2013.01);
(Continued)

(58) Field of Classification Search
CPC ..... H04S 7/303; H04S 7/304; H04S 2420/11; H04S 2420/03; H04S 2400/11;
(Continued)

(56) References Cited

U.S. PATENT DOCUMENTS

2012/0206452 A1* 8/2012 Geisner ..... H04S 7/304 345/419
2012/0314871 A1 12/2012 Koga
(Continued)

FOREIGN PATENT DOCUMENTS

CN 102855116 A 1/2013
WO 2016/185740 A1 11/2016

OTHER PUBLICATIONS

International Search Report and Written Opinion dated Sep. 18, 2018 for PCT/JP2018/026655 filed on Jul. 17, 2018, 6 pages including English Translation of the International Search Report.
(Continued)

*Primary Examiner* — Paul Kim
*Assistant Examiner* — Ubachukwu A Odunukwe
(74) *Attorney, Agent, or Firm* — Xsensus LLP

(57) ABSTRACT

An information processing apparatus includes a calculation section that calculates a relative position of a sound source of a virtual object to a user, the virtual object allowing a user to perceive that the virtual object exists in a real space by sound image localization, on the basis of a position of a sound image of the virtual object and a position of the user, a sound image localization section that performs a sound signal process of the sound source such that the sound image is localized at the calculated localization position, and a sound image position holding section that holds the position of the sound image. When sound to be emitted from the virtual object is to be changed over, the calculation section may refer to the position of the sound image held in the
(Continued)

sound image position holding section to calculate the position of the sound image.

11 Claims, 23 Drawing Sheets

(51) Int. Cl.
*H04R 5/02* (2006.01)
*H04R 1/02* (2006.01)
*H04R 1/40* (2006.01)
*H04S 3/00* (2006.01)

(52) U.S. Cl.
CPC ..... *H04R 5/02* (2013.01); *H04S 3/008* (2013.01); *H04S 2400/01* (2013.01); *H04S 2400/11* (2013.01)

(58) Field of Classification Search
CPC . H04S 7/306; H04S 3/008; H04S 7/40; H04R 1/403; H04R 5/033; H04R 3/12; H04R 5/02; G10L 19/008
USPC ..... 381/303; 345/632, 633, 419
See application file for complete search history.

(56) References Cited

U.S. PATENT DOCUMENTS

2014/0300636 A1* 10/2014 Miyazaya ..... H04S 7/304 345/633
2014/0321680 A1 10/2014 Takahashi et al.
2018/0048976 A1 2/2018 Kimura et al.
2018/0192226 A1* 7/2018 Woelfl ..... G10K 11/17815

OTHER PUBLICATIONS

Office Action dated Dec. 17, 2020 in Chinese Patent Application No. 201880049905.4, 22 pages.

* cited by examiner

FIG. 12

Node

| PARAMETER | DATA TYPE | EXPLANATION |
|---|---|---|
| id | string | ID OF NODE |
| element | Element | ELEMENT (DirectionalSoundElement, ETC.) |
| branch | Transition[] | LIST OF TRANSITION INFORMATION |

Transition

| PARAMETER | DATA TYPE | EXPLANATION |
|---|---|---|
| target_id_ref | string | ID OF TRANSITION DESTINATION NODE |
| condition | Condition | TRANSITION CONDITION |

DirectionalSoundElement(extends Element)

| PARAMETER | DATA TYPE | EXPLANATION |
|---|---|---|
| stream_id | string | ID OF ELEMENT |
| sound_id_ref | string | ID OF SOUND DATA TO BE REFERRED TO |
| keyframes_ref | string | ID OF ANIMATION KEY FRAME |
| stream_id_ref | string | stream_id DESIGNATED TO DIFFERENT DirectionalSoundElement |

FIG. 13

Animations

| PARAMETER | DATA TYPE | EXPLANATION |
|---|---|---|
| <Animation ID> | KeyFrame[] | Keyframe ARRAY USING ANIMATION ID AS KEY |

KeyFrame

| PARAMETER | DATA TYPE | EXPLANATION |
|---|---|---|
| time | number | ELAPSED TIME [ms] |
| interpolation | string | INTERPOLATION METHOD TO NEXT keyframe (ONLY TO LAST keyframe, OPTIONAL) |
| distance | number | DISTANCE [m] FROM ITS OWN |
| azimuth | number | RELATIVE ORIENTATION [deg] FROM ITS OWN (FRONT 0, RIGHT +90, LEFT -90) |
| elevation | number | ELEVATION ANGLE [deg] FROM EAR (TOP POSITIVE, BOTTOM NEGATIVE) |
| pos_x | number | LEFT/RIGHT POSITION [m] WITH ITS OWN ZERO, RIGHT POSITIVE |
| pos_y | number | FRONT/BACK POSITION [m] WITH ITS OWN ZERO, FRONT POSITIVE |
| pos_z | number | TOP/BOTTOM POSITION [m] WITH ITS OWN ZERO TOP POSITIVE |

FIG. 14

Keyframe#interpolation

| VALUE | EXPLANATION |
|---|---|
| "NONE" | NO INTERPOLATION, VALUE OF CURRENT KEY FRAME IS NOT CHANGED TILL TIME OF NEXT KEY FRAME |
| "LINEAR" | LINEAR INTERPOLATION |
| "EASE_IN_QUAD" | INTERPOLATE SUCH THAT OUTSET BECOMES SMOOTH BY QUADRATIC FUNCTION |
| "EASE_OUT_QUAD" | INTERPOLATE SUCH THAT TERMINATION BECOMES SMOOTH BY QUADRATIC FUNCTION |
| "EASE_IN_OUT_QUAD" | INTERPOLATE SUCH THAT OUTSET AND TERMINATION BECOME SMOOTH BY QUADRATIC FUNCTION |
| ... | ... |

INFORMATION PROCESSING APPARATUS, INFORMATION PROCESSING METHOD AND PROGRAM

CROSS-REFERENCE TO RELATED APPLICATIONS

The present application is based on PCT filing PCT/JP2018/026655, filed Jul. 17, 2018, which claims priority to JP 2017-147722, filed Jul. 31, 2017, the entire contents of each are incorporated herein by reference.

TECHNICAL FIELD

The present technique relates to an information processing apparatus, an information processing method and a program and, and particularly to an information processing apparatus, an information processing method and a program suitable for application, for example, to an AR (Augmented Reality) game and so forth.

BACKGROUND ART

Together with the progress of information processing and information communication technologies, a computer is widely spread and is positively utilized also for support of daily file and amusement. Recently, computer processing is utilized also in the field of entertainment, and such entertainment as just described is not only utilized by a user who works in a specific place such as an office or a home but also demanded by a user who is moving.

Regarding entertainment during movement, for example, PTL 1 specified below proposes an information processing apparatus in which an interaction of a character displayed on a screen is controlled in response to a rhythm of the body of a user during movement to get a sense of intimacy of the user to allow the user to enjoy the movement itself as entertainment.

CITATION LIST

Patent Literature

[PTL 1]
Japanese Patent Laid-Open No. 2003-305278

SUMMARY

Technical Problem

However, in PTL 1 mentioned above, since an image of a character is displayed on a display screen, the entertainment cannot be enjoyed in a case where it is difficult to watch a screen image during walking or running. Further, it is desired to make it possible for a user to enjoy for a longer period of type on an information processing apparatus for entertaining a user.

The present technique has been made in view of such a situation as described above and makes it possible to entertain a user.

Solution to Problem

An information processing apparatus of one aspect of the present technique includes a calculation section that calculates a relative position of a sound source of a virtual object to a user, the virtual object allowing the user to perceive such that the virtual object exists in a real space by sound image localization, on the basis of a position of a sound image of the virtual object and a position of the user, a sound image localization section that performs a sound signal process of the sound source such that the sound image is localized at the calculated localization position, and a sound image position holding section that holds the position of the sound image, and in which, when sound to be emitted from the virtual object is to be changed over, in a case where a position of a sound image of sound after the changeover is to be set to a position that takes over a position of the sound image of the sound before the changeover, the calculation section refers to the position of the sound image held in the sound image position holding section to calculate the position of the sound image.

An information processing method of the one aspect of the present technique includes the steps of calculating a relative position of a sound source of a virtual object to a user, the virtual object allowing the user to perceive such that the virtual object exists in a real space by sound image localization, on the basis of a position of a sound image of the virtual object and a position of the user, performing a sound signal process of the sound source such that the sound image is localized at the calculated localization position, and updating the position of the held sound image, and in which, when sound to be emitted from the virtual object is to be changed over, in a case where a position of a sound image of sound after the changeover is to be set to a position that takes over a position of the sound image of the sound before the changeover, the held position of the sound image is referred to calculate the position of the sound image.

A program of the one aspect of the present technique is for causing a computer to execute a process including the steps of calculating a relative position of a sound source of a virtual object to a user, the virtual object allowing the user to perceive such that the virtual object exists in a real space by sound image localization, on the basis of a position of a sound image of the virtual object and a position of the user, performing a sound signal process of the sound source such that the sound image is localized at the calculated localization position, and updating the position of the held sound image, and in which, when sound to be emitted from the virtual object is to be changed over, in a case where a position of a sound image of sound after the changeover is to be set to a position that takes over a position of the sound image of the sound before the changeover, the held position of the sound image is referred to calculate the position of the sound image.

In the information processing apparatus, information processing method and program of the one aspect of the present technique, a relative position of a sound source of a virtual object, which allows a user to perceive such that the virtual object exists in a real space by sound image localization, to the user is calculated on the basis of a position of a sound image of the virtual object and a position of the user, and a sound signal process of the sound source is performed such that the sound image is localized at the calculated localization position and the held position of the sound image is updated. Further, when sound to be emitted from the virtual object is to be changed over, in a case where a position of a sound image of sound after the changeover is to be set to a position that takes over a position of the sound image of the sound before the changeover, the position of the sound image held in the sound image position holding section is referred to calculate the position of the sound image.

It is to be noted that the information processing apparatus may be an independent apparatus or may be an internal block configuring one apparatus.

Further, the program can be provided by transmission through a transmission medium or as a recording medium on which it is recorded.

Advantageous Effect of Invention

With the one aspect of the present technique, it can entertain its user.

It is to be noted that the advantageous effect described herein is not necessarily restrictive and may be any advantageous effect disclosed in the present disclosure.

BRIEF DESCRIPTION OF DRAWINGS

FIG. 12 is a view illustrating a configuration of a node.

FIG. 13 is a view illustrating a configuration of a key frame.

FIG. 14 is a view illustrating interpolation between key frames.

DESCRIPTION OF EMBODIMENT

In the following, a mode for carrying out the present technique (hereinafter referred to as an embodiment) is described.

<Outline of Information Processing Apparatus According to Embodiment of Present Disclosure>

Figure 1:
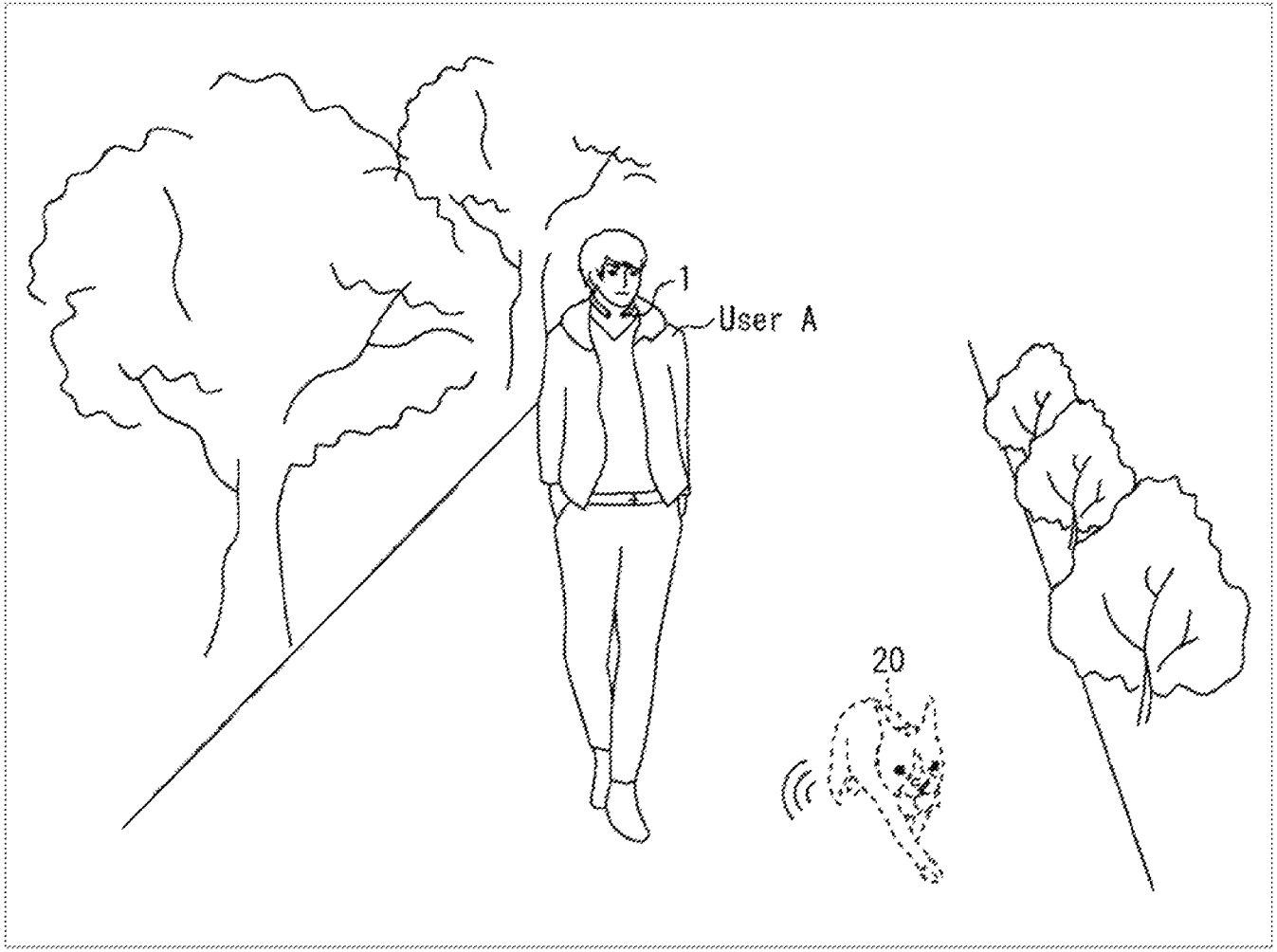
FIG. 1 is a view illustrating an outline of an information processing apparatus to which the present technique is applied.

First, an outline of an information processing apparatus according to the embodiment of the present disclosure is described with reference to FIG. 1. As depicted in FIG. 1, the information processing apparatus 1 according to the present embodiment is, for example, a neckband type information processing apparatus capable of being worn on the neck of a user A, and includes a speaker and various sensors (an acceleration sensor, a gyroscope sensor, a geomagnetism sensor, an absolute position measurement section and so forth). Such an information processing apparatus 1 as just described has a function for allowing the user to sense such that a virtual character 20 really exists in the real space by a sound image localization technique for disposing sound information spatially. It is to be noted that the virtual character 20 is an example of a virtual object. The virtual object may be an object such as a virtual radio or a virtual musical instrument, an object that generates noise in the city (for example, sound of a car, sound of a railway crossing, chat sound in a crowd or the like) or the like may be used.

Therefore, the information processing apparatus 1 according to the present embodiment makes it possible to suitably calculate a relative three-dimensional position for positioning sound for causing a virtual character to be sensed on the basis of a state of a user and information of a virtual character and then present the presence of the virtual object in the real space with a higher degree of reality. In particular, for example, the information processing apparatus 1 can calculate a relative height for positioning voice of a virtual character to perform sound image localization on the basis of a height and a state of the user A (standing, sitting or the like) and height information of the virtual character such that the size of the virtual character is actually sensed by the user.

Further, the information processing apparatus 1 can vary sound of the virtual character in response to a state or movement of the user A to implement that reality is applied to movement of the virtual character. At this time, the information processing apparatus 1 performs control so as to localize a corresponding portion of the virtual character on the basis of a type of sound such that sound of the voice of the virtual character is localized at the mouth (head) of the virtual character while footsteps of the virtual character are localized at the feet of the virtual character.

An outline of the information processing apparatus 1 according to the present embodiment has been described. Now, a configuration of the information processing apparatus 1 according to the present embodiment is described with reference to FIGS. 2 and 3.

<Configuration of Appearance of Information Processing Apparatus>

Figure 2:
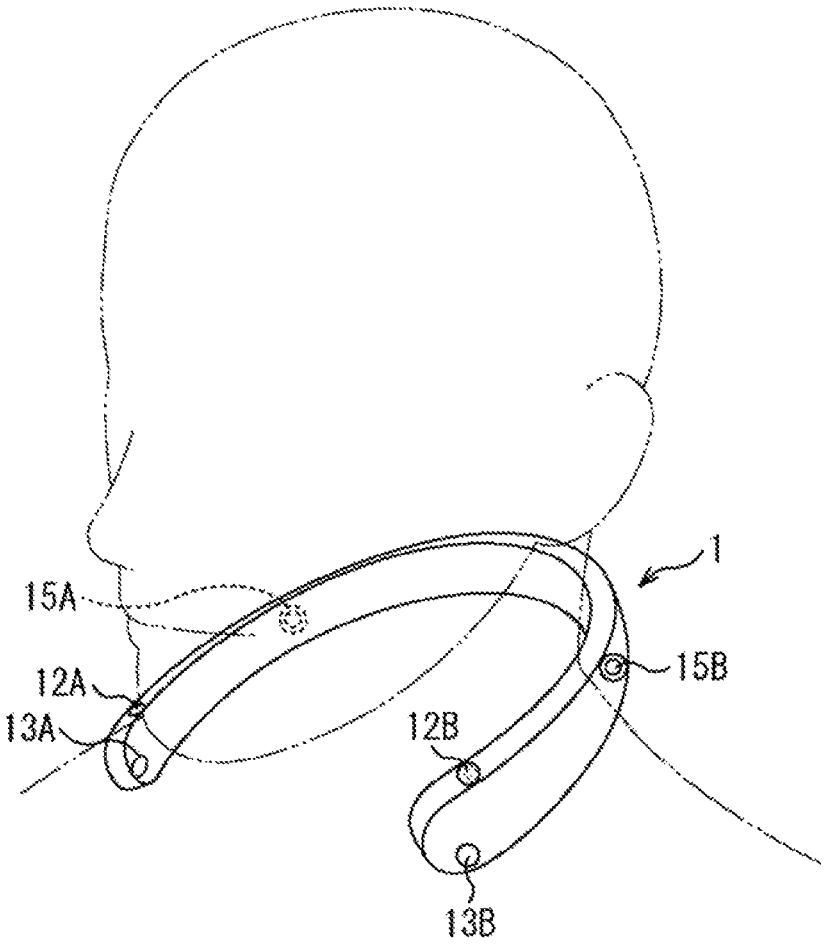
FIG. 2 is a perspective view depicting an example of an appearance configuration of the information processing apparatus to which the present technique is applied.

FIG. 2 is a perspective view depicting an example of an appearance configuration of the information processing apparatus 1 according to the present embodiment. The information processing apparatus 1 is a so-called wearable terminal. As depicted in FIG. 2, the neckband type information processing apparatus 1 has a mounting unit having a shape over one half circumference from both sides of the neck to the rear side (back side) (housing configured for mounting), and is mounted on the user by being worn on the neck of the user. In FIG. 2, a perspective view in a state in which the user wears the mounting unit is depicted.

It is to be noted that, although, in the present document, a word indicating a direction such as, upward, downward, leftward, rightward, forward or rearward, it is assumed that the directions individually indicate directions as viewed from the center of the body of the user (for example, a position of the pit of the stomach) in an uprightly standing posture of the user. For example, it is assumed that "right" indicates a direction of the right half body side of the user and "left" indicates the direction of the left half body side of the user, and "up" indicates the direction of the head side of the user and "down" indicates the direction of the foot side of the user. Further, it is assumed that "front" indicates the direction in which the body of the user is directed and "rear" indicates the direction of the back side of the user.

As depicted in FIG. 2, the mounting unit may be worn in a closely contacting relationship with the neck of the user or may be worn in a spaced relationship from the neck of the user. It is to be noted that, as a different shape of a neck wearing type mounting unit, for example, a pendant type worn by the user through a neck strap or a headset type having a neck band passing the rear side of the neck in place of a headband to be worn on the head is conceivable.

Further, a usage of the mounting unit may be a mode in which it is used in a state directly mounted on the human body. The mode in which the mounting unit is used in a state directly mounted signifies a mode in which the mounting unit is used in a state in which no object exists between the mounting unit and the human body. For example, a mode in which the mounting unit depicted in FIG. 2 is mounted so as to contact with the skin of the neck of the user is applicable as the mode described above. Further, various other modes such as a headset type directly mounted on the head or a glass type are conceivable.

Alternatively, the usage of the mounting unit may be a mode in which the mounting unit is used in an indirectly mounted relationship on the human body. The mode in which the mounting unit is used in an indirectly mounted state signifies a mode in which the mounting unit is used in a state in which some object exists between the mounting unit and the human body. For example, the case where the mounting unit is mounted so as to contact with the user through clothes as in a case in which the mounting unit depicted in FIG. 2 is mounted so as to hide under a collar of a shirt is applicable as the present mode. Further, various modes such as a pendant type mounted on the user by a neck strap or a brooch type fixed by a fastener on clothes are conceivable.

Further, as depicted in FIG. 2, the information processing apparatus 1 includes a plurality of microphones 12 (12A, 12B), cameras 13 (13A, 13B) and speakers 15 (15A, 15B). The microphone 12 acquires sound data such as user sound or peripheral environment sound. The cameras 13 captures images of the surroundings and acquire image data. Further, the speakers 15 perform reproduction of sound data. Especially, the speakers 15 according to the present embodiment reproduce a sound signal after a sound image localization process of a virtual character for allowing a user to sense such that the virtual character actually exists in the real space.

In this manner, the information processing apparatus 1 is configured such that it at least includes a housing that incorporates a plurality of speakers for reproducing a sound signal after the sound image positioning process and is configured for mounting on part of the body of the user.

It is to be noted that, while FIG. 2 depicts the configuration that the two microphones 12, two cameras 13 and two speakers 15 are provided on the information processing apparatus 1, the present embodiment is not limited to this. For example, the information processing apparatus 1 may include one microphone 12 and one camera 13 or may include three or more microphones 12, three or more cameras 13 and three or more speakers 15.

<Internal Configuration of Information Processing Apparatus>

Figure 3:
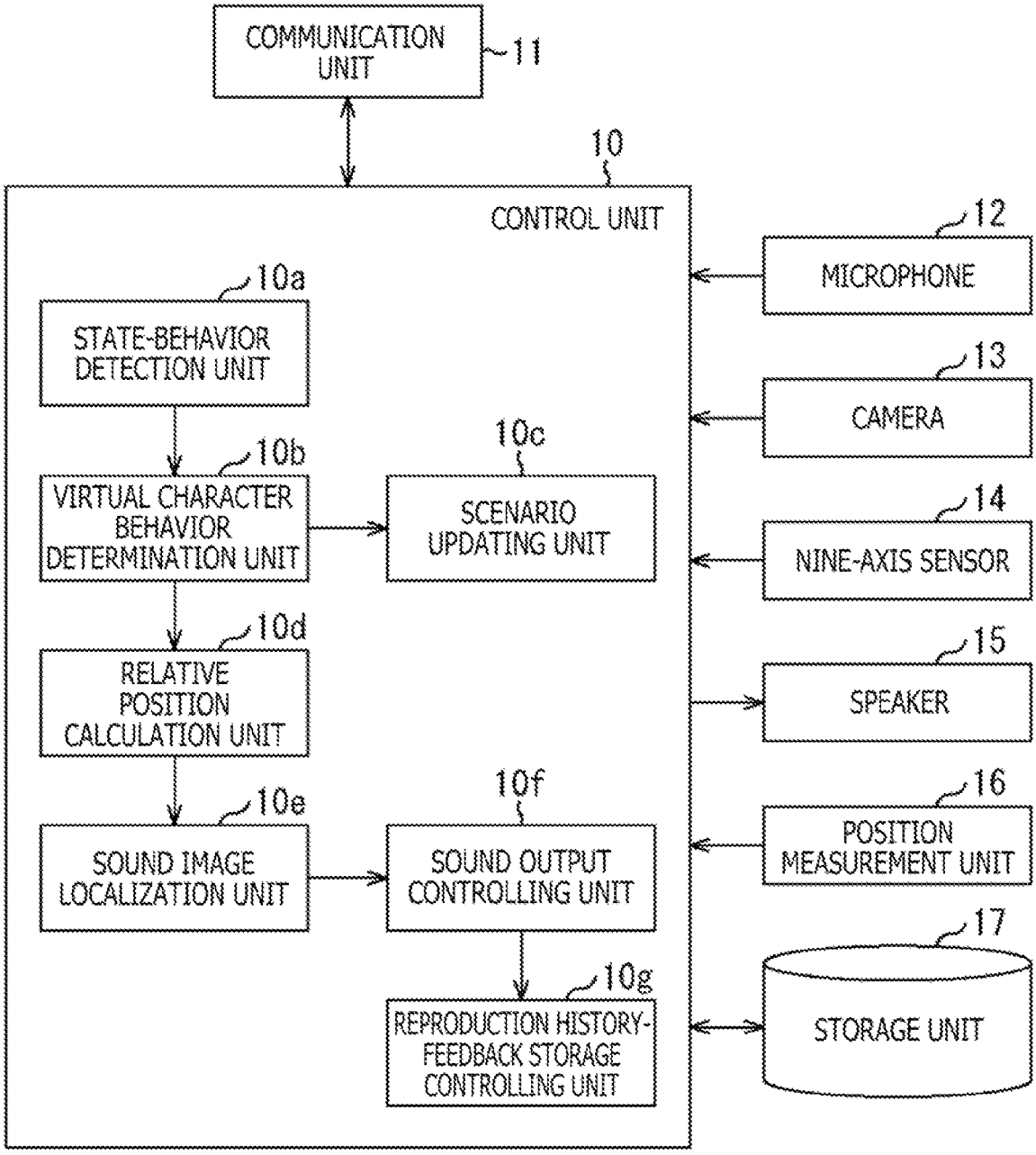
FIG. 3 is a block diagram depicting an example of an internal configuration of the information processing apparatus.

Now, an internal configuration of the information processing apparatus 1 according to the present embodiment is described referring to FIG. 3. FIG. 3 is a block diagram depicting an example of an internal configuration of the information processing apparatus 1 according to the present embodiment. As depicted in FIG. 3, the information processing apparatus 1 includes a control section 10, a communication section 11, a microphone 12, a camera 13, a nine-axis sensor 14, a speaker 15, a position measurement section 16 and a storage section 17.

The control section 10 functions as an arithmetic operation processing apparatus and a control apparatus, and controls overall operation in the information processing apparatus 1 in accordance with various programs. The control section 10 is implemented by electronic circuitry such as, for example, a CPU (Central Processing Unit) or a microprocessor. Further, the control section 10 may include a ROM (Read Only Memory) that stores programs, arithmetic operation parameters and so forth to be used and a RAM (Random Access Memory) that temporarily stores parameters and so forth that change suitably.

Further, as depicted in FIG. 3, the control section 10 according to the present embodiment functions as a state-behavior detection section 10*a*, a virtual character behavior determination section 10*b*, a scenario updating section 10*c*, a relative position calculation section 10*d*, a sound image localization section 10*e*, a sound output controlling section 10*f* and a reproduction history-feedback storage controlling section 10*g*.

The state-behavior detection section 10*a* performs detection of a state of a user and recognition of a behavior based on the detected state and outputs the detected state and the recognized behavior to the virtual character behavior determination section 10*b*. In particular, the state-behavior detection section 10*a* acquires such information as position information, a moving speed, an orientation, a height of the ear (or head) as information relating to the state of the user. The user state is information that can be uniquely specified at the detected timing and can be calculated and acquired as numerical values from various sensors.

For example, the position information is acquired from the position measurement section 16. Further, the moving speed is acquired from the position measurement section 16, the acceleration sensor included in the nine-axis sensor 14, the camera 13 or the like. The orientation is acquired from the gyro sensor, acceleration sensor and geomagnetic sensor included in the nine-axis sensor 14 or from the camera 13. The height of the ear (or the head) is acquired from physique data of the user, the acceleration sensor and the gyro sensor. Further, the moving speed and the orientation may be acquired using SLAM (Simultaneous Localization and Mapping) for calculating a movement on the basis of a change of feature points in videos when the surroundings are successively imaged using the camera 13.

Figure 4:
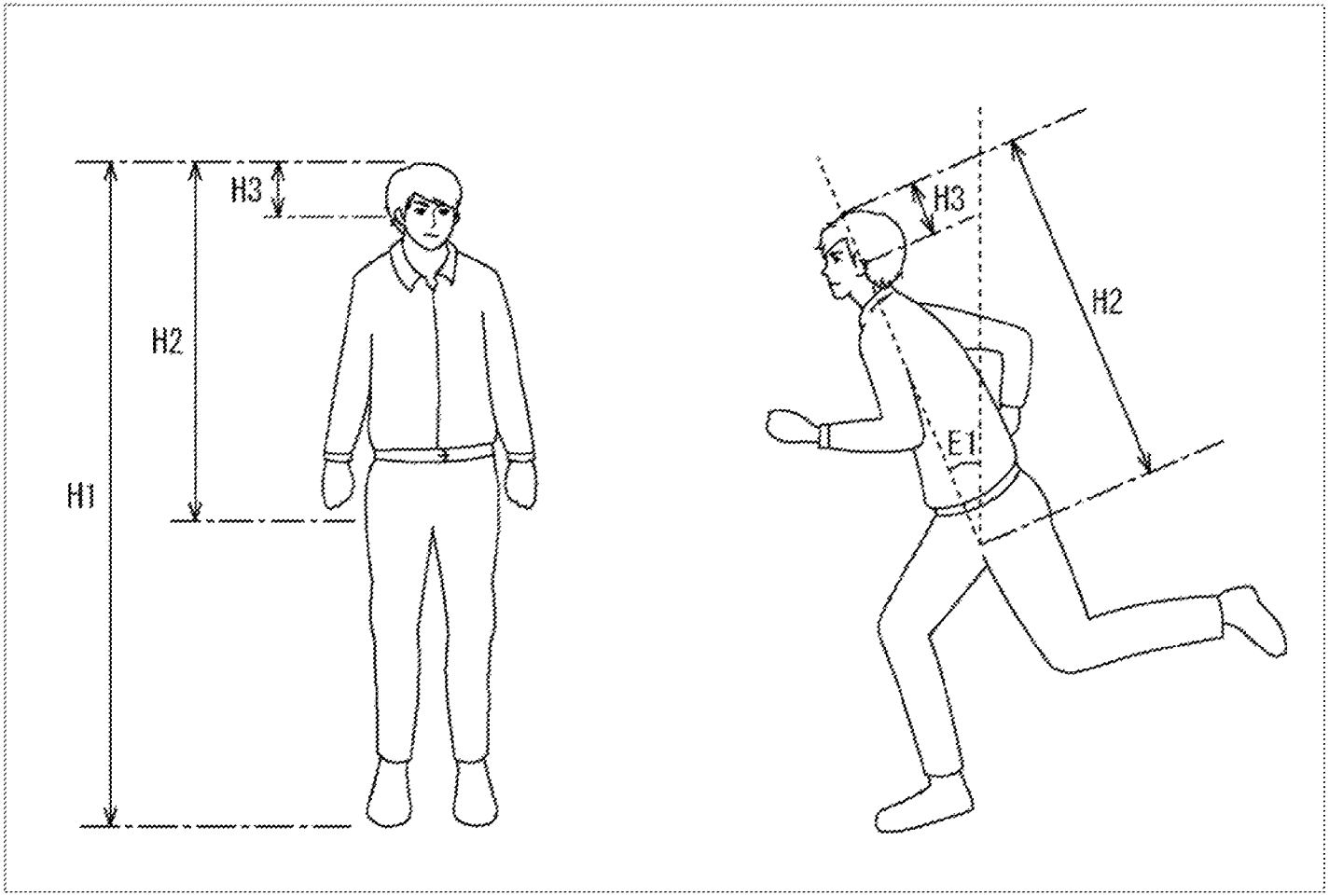
FIG. 4 is a view illustrating physique data of a user.

Meanwhile, the height of the ear (or the head) can be calculated on the basis of physique data of the user. As the physique data of the user, the stature H1, sitting height H2 and distance H3 from the ear to the top of the head are set, for example, as depicted in a left view in FIG. 4 and stored into the storage section 17. The state-behavior detection section 10*a* calculates the height of the ear, for example, in the following manner. It is to be noted that "E1 (inclination of the head)" can be detected as an inclination of the upper body as depicted in a right view in FIG. 4 by the acceleration sensor, the gyro sensor or the like.

(Expression 1) In a case where the user stands uprightly:

Height of ear=stature−sitting height+(sitting height−distance from ear to top of head)×$E1$ (inclination of head)

(Expression 2) In a case where the user is sitting/lying:

Height of ear=(sitting height−distance from ear to top of head)×$E1$ (inclination of head)

The physique data of the user may be generated by other formulae.

Also it is possible for the state-behavior detection section 10*a* to recognize a user behavior by referring to the preceding and succeeding states. As the user behavior, for example, "stopping," "walking," "running," "sitting," "lying," "in a car," "riding a bicycle," "oriented to a character" and so forth are supposed. Also it is possible for the state-behavior detection section 10*a* to recognize a user behavior using a predetermined behavior recognition engine on the basis of information detected by the nine-axis sensor 14 (acceleration sensor, gyro sensor and geomagnetic sensor) and the position information detected by the position measurement section 16.

The virtual character behavior determination section 10*b* determines a virtual behavior in the real space of the virtual character 20 in response to the user behavior recognized by the state-behavior detection section 10*a* (or including also selection of a scenario) and selects a sound content corresponding to the determined behavior from a scenario.

For example, the virtual character behavior determination section 10*b* can present the presence of the virtual character by causing the virtual character to take a same action as that of the user such that, for example, when the user is walking, the virtual character behavior determination section 10*b* causes also the virtual character 20 to walk, but when the user is running, the virtual character behavior determination section 10*b* causes the virtual character 20 to run in such a manner as to follow the user.

Further, after a behavior of the virtual character is determined, the virtual character behavior determination section 10*b* selects, from within a sound source list (sound contents) stored in advance as scenarios of contents, a sound source corresponding to the behavior of the virtual character. Thereupon, in regard to a sound source having a limited number of reproductions, the virtual character behavior determination section 10*b* decides permission/inhibition of reproduction on the basis of a reproduction log. Further, the virtual character behavior determination section 10*b* may select a sound source that corresponds to the behavior of the virtual character and meets preferences of the user (a sound source of a favorite virtual character or the like) or a sound source of a specific virtual character tied with the present location (place).

For example, in a case where the determined behavior of the virtual character is that the virtual character is stopping, the virtual character behavior determination section 10*b* selects a sound content of voice (for example, lines, breath or the like), but in a case where the determined behavior is that the virtual character is walking, the virtual character behavior determination section 10*b* selects a sound content of voice and another sound content of footsteps. Further, in a case where the determined behavior of the virtual character is that the virtual character is running, the virtual character behavior determination section 10*b* selects shortness of breath or the like as a sound content. In this manner, a sound content is selected and selective sounding according to the behavior is executed (in other words, a sound content that does not correspond to the behavior is not selected and not reproduced).

Since the scenario progresses through selection of a sound content corresponding to the behavior of the virtual character determined by the virtual character behavior determination section 10*b* from within the scenario, the scenario updating section 10*c* performs updating of the scenario. The scenario is stored, for example, in the storage section 17.

The relative position calculation section 10*d* calculates a relative three-dimensional position (xy coordinate positions and height) for localizing a sound source of the virtual character (sound content) selected by the virtual character behavior determination section 10*b*. In particular, the relative position calculation section 10*d* first sets a position of a portion of a virtual character corresponding to a type of a sound source by referring to the behavior of the virtual character determined by the virtual character behavior determination section 10*b*. The relative position calculation section 10*d* outputs the calculated sound localization position (three-dimensional position) for each sound content to the sound image localization section 10*e*.

The sound image localization section 10*e* performs a sound signal process for a sound content such that a corresponding sound content (sound source) selected by the virtual character behavior determination section 10*b* is localized at the sound image localization position for each content calculated by the relative position calculation section 10*d*.

The sound output controlling section 10*f* controls such that a sound signal processed by the sound image localization section 10*e* is reproduced by the speaker 15. Consequently, the information processing apparatus 1 according to the present embodiment can localize a sound image of a sound content, which corresponds to a movement of the virtual character according to a state and behavior of the user, at an appropriate position, distance and height to the user, presents reality in movement and size of the virtual character and increase the presence of the virtual character in the real space.

The reproduction history-feedback storage controlling section 10*g* controls such that a sound source (sound content) outputted in sound from the sound output controlling section 10*f* is stored as a history (reproduction log) into the storage section 17. Further, the reproduction history-feedback storage controlling section 10*g* controls such that, when sound is outputted by the sound output controlling section 10*f*, such a reaction of the user that the user turns to a direction of the voice or stops and listens to a story is stored as feedback into the storage section 17. Consequently, the control section 10 is enabled to learn user's tastes and the virtual character behavior determination section 10*b* described above can select a sound content according to the user's tastes.

The communication section 11 is a communication module for performing transmission and reception of data to and from a different apparatus by wired/wireless communication. The communication section 11 wirelessly communicate with an external apparatus directly or through a network access point by such a method as, for example, a wired LAN (Local Area Network), a wireless LAN, Wi-Fi (Wireless Fidelity, registered trademark), infrared communication, Bluetooth (registered trademark) or a near field/contactless communication method.

For example, in a case where the functions of the control section 10 described above are included in a different apparatus such as a smartphone or a server on the cloud, the communication section 11 may transmit data acquired by the microphone 12, camera 13 or nine-axis sensor 14. In this case, behavior determination of a virtual character, selection of a sound content, calculation of a sound image localization position, a sound image localization process and so forth are performed by the different apparatus. Further, in a case where, for example, the microphone 12, camera 13 or nine-axis sensor 14 is provided in the different apparatus, the communication section 11 may receive data acquired by them and output the data to the control section 10. Further, the communication section 11 may receive a sound content selected by the control section 10 from a different apparatus such as a server on the cloud.

The microphone 12 collects voice of the user and sound of an ambient environment and outputs them as sound data to the control section 10.

The camera 13 includes a lens system configured from an imaging lens, a diaphragm, a zoom lens, a focusing lens and so forth, a driving system for causing the lens system to perform focusing operation and zooming operation, a solid-state imaging element array for photoelectrically converting imaging light obtained by the lens system to generate an imaging signal, and so forth. The solid-state imaging element array may be implemented, for example, by a CCD (Charge Coupled Device) sensor array or a CMOS (Complementary Metal Oxide Semiconductor) sensor array.

For example, the camera 13 may be provided for imaging the front from the user in a state in which the information processing apparatus 1 (mounting unit) is mounted on the user. In this case, the camera 13 can image a movement of the surrounding landscape, for example, according to the movement of the user. Further, the camera 13 may be provided for imaging the face of the user in a state in which the information processing apparatus 1 is mounted on the user. In this case, the information processing apparatus 1 can specify the position of the ear or the facial expression of the user from the captured image. Further, the camera 13 outputs data of the captured image in the form of a digital signal to the control section 10.

The nine-axis sensor 14 includes a three-axis gyro sensor (detection of angular velocities (rotational speeds)), a three-axis acceleration sensor (also called G sensor: detection of accelerations upon movement) and a three-axis geomagnetism sensor (compass: detection of an absolution direction (orientation)). The nine-axis sensor 14 has a function of sensing a state of a user who mounts the information processing apparatus 1 thereon or a surrounding situation. It is to be noted that the nine-axis sensor 14 is an example of a sensor section and the present embodiment is not limited to this, and, for example, a velocity sensor, a vibration sensor or the like may be used further or at least one of an acceleration sensor, a gyro sensor or a geomagnetism sensor may be used.

Further, the sensor section may be provided in an apparatus different from the information processing apparatus 1 (mounting unit) or may be provided dispersedly in a plurality of apparatus. For example, the acceleration sensor, gyro sensor and geomagnetism sensor may be provided on a device mounted on the head (for example, an earphone) and the acceleration sensor or the vibration sensor may be provided on a smartphone. The nine-axis sensor 14 outputs information indicative of a sensing result to the control section 10.

The speaker 15 reproduces an audio signal processed by the sound image localization section 10*e* under the control of the sound output controlling section 10*f*. Further, also it is possible for the speaker 15 to convert a plurality of sound sources of arbitrary positions/directions into stereo sound and output the stereo sound.

The position measurement section 16 has a function for detecting the present position of the information processing apparatus 1 on the basis of an acquisition signal from the outside. In particular, for example, the position measurement section 16 is implemented by a GPS (Global Positioning System) measurement section, and receives radio waves from GPS satellites to detect the position at which the information processing apparatus 1 exists and outputs the detected position information to the control section 10. Further, the information processing apparatus 1 may detect the position, in addition to the GPS, by transmission and reception, for example, by Wi-Fi (registered trademark), Bluetooth (registered trademark), a portable telephone set, a PHS, a smartphone and so forth or by near field communication or the like.

The storage section 17 stores programs and parameters for allowing the control section 10 to execute the functions described above. Further, the storage section 17 according to the present embodiment stores scenarios (various sound contents), setting information of virtual characters (shape, height and so forth) and user information (name, age, home, occupation, workplace, physique data, hobbies and tastes, and so forth). It is to be noted that at least part of information stored in the storage section 17 may be stored in a different apparatus such as a server on the cloud or the like.

The configuration of the information processing apparatus 1 according to the present embodiment has been described particularly.

<Operation of Information Processing Apparatus>

Figure 5:
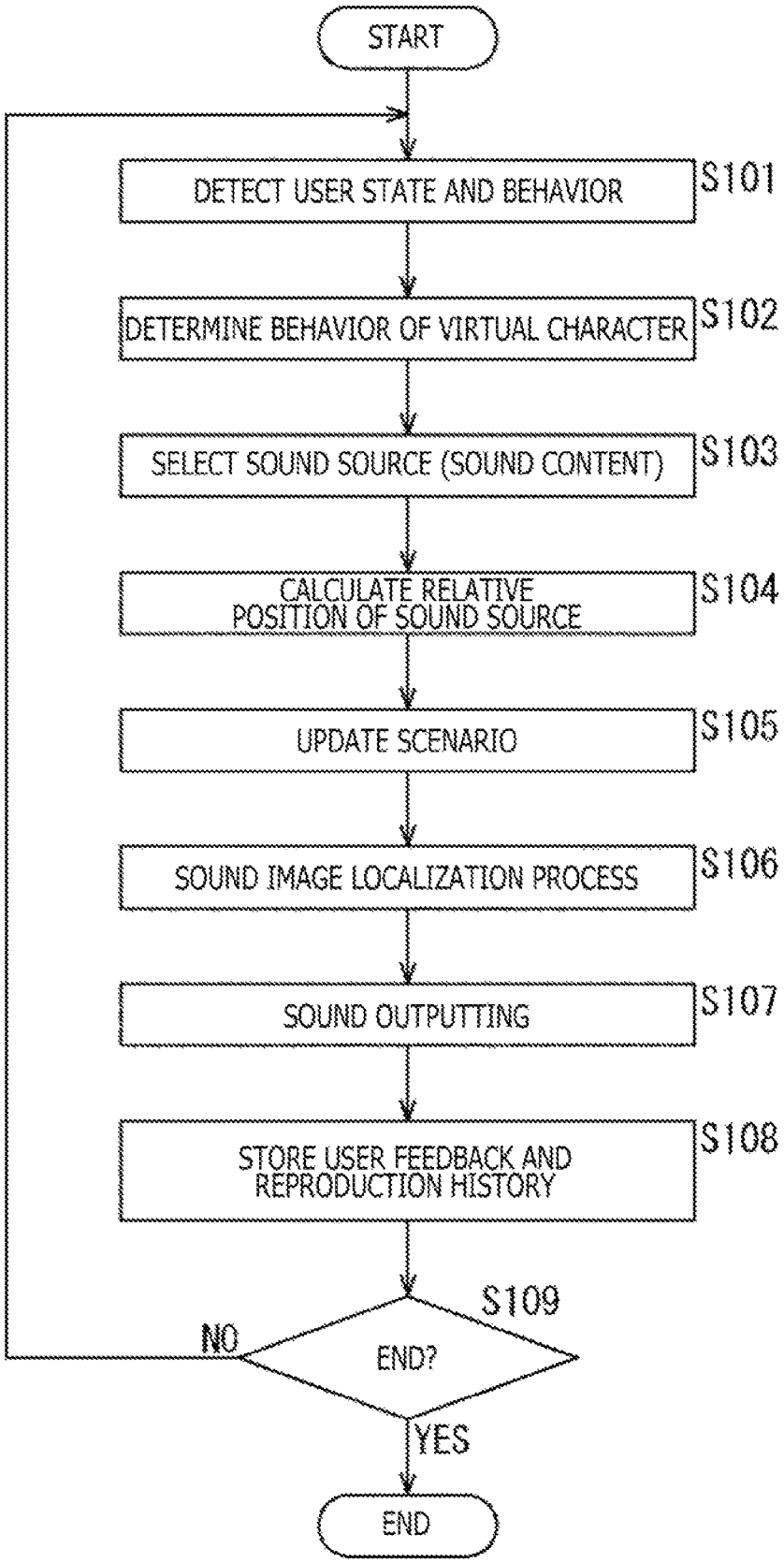
FIG. 5 is a flow chart illustrating operation of the information processing apparatus.

Subsequently, a sound process of the information processing apparatus 1 according to the present embodiment is described with reference to FIG. 5. FIG. 5 is a flow chart depicting the sound process according to the present embodiment.

As depicted in FIG. 5, first at step S101, the state-behavior detection section 10*a* of the information processing apparatus 1 detects a user state and behavior on the basis of information detected by various sensors (microphone 12, camera 13, nine-axis sensor 14 or position measurement section 16).

At step S102, the virtual character behavior determination section 10*b* determines a behavior of a virtual character to be reproduced in response to the detected state and behavior of the user. For example, the virtual character behavior determination section 10*b* determines a behavior same as the detected behavior of the user (for example, such that, if the user walks, then the virtual character walks together, if the user runs, then the virtual character runs together, if the user sits, then the virtual character sits, if the user lies, then the virtual character lies, or the like).

At step S103, the virtual character behavior determination section 10*b* selects a sound source (sound content) corresponding to the determined behavior of the virtual character from a scenario.

At step S104, the relative position calculation section 10*d* calculates a relative position (three-dimensional position) of the selected sound source on the basis of the detected user state and user behavior, physique data of the stature or the like of the user registered in advance, determined behavior of the virtual character, setting information of the stature of the virtual character registered in advance and so forth.

At step S105, the scenario updating section 10*c* updates the scenario in response to the determined behavior of the virtual character and the selected sound content (namely, advances to the next event).

At step S106, the sound image localization section 10*e* performs a sound image localization process for the corresponding sound content such that the sound image is localized at the calculated relative position for the sound image.

At step S107, the sound output controlling section 10*f* controls such that the sound signal after the sound image localization process is reproduced from the speaker 15.

At step S108, a history of the reproduced (namely outputted in sound) sound content and feedback of the user to the sound content are stored into the storage section 17 by the reproduction history-feedback storage controlling section 10*g*.

Steps S103 to S124 described above are repeated until the event of the scenario comes to an end at step S109. For example, if one game comes to an end, then the scenario ends.

As described above, the information processing system according to the embodiment of the present disclosure makes it possible to appropriately calculate a relative three-dimensional position for localizing sound, which allows a virtual character (an example of a virtual object) to be perceived, on the basis of the state of the user and information of the virtual character and present the presence of the virtual character in the real space with a higher degree of reality.

Meanwhile, the information processing apparatus 1 according to the present embodiment may be implemented by an information processing system including a headphone (or an earphone, eyewear or the like) in which the speaker 15 is provided and a mobile terminal (smartphone or the like) having functions principally of the control section 10. On this occasion, the mobile terminal transmits a sound signal subjected to a sound localization process to the headphone so as to be reproduced. Further, the speaker 15 is not limited to being incorporated in an apparatus mounted on the user but may be implemented, for example, by an environmental speaker installed around the user, and in this case, the environmental speaker can localize a sound image at an arbitrary position around the user.

Now, sound to be emitted by execution of the processes described above is described. First, an example of a three-dimensional position including xy coordinate positions and height is described with reference to FIG. 6.

Figure 6:
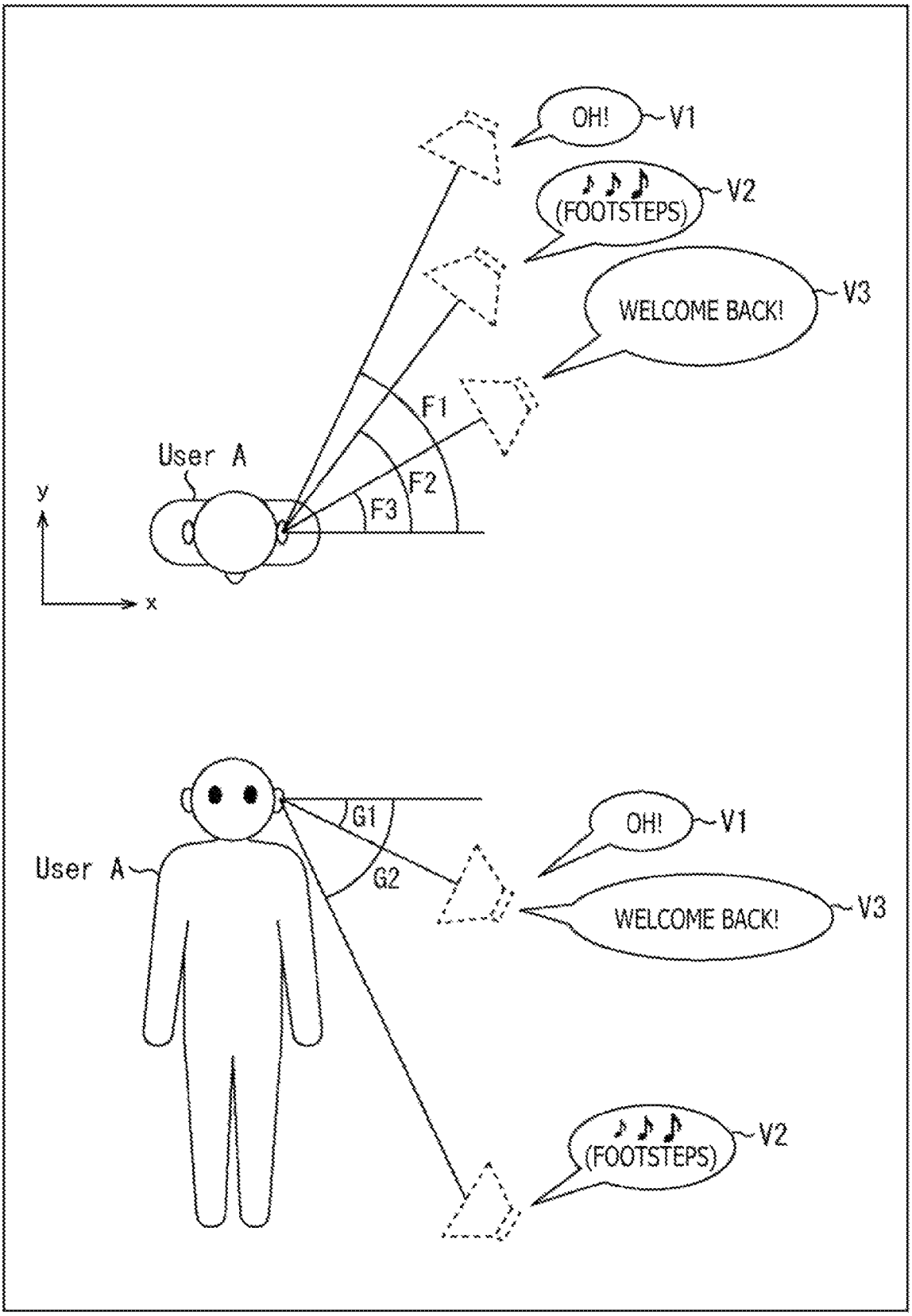
FIG. 6 is a view illustrating a sound image.

FIG. 6 is a view illustrating an example of sound image localization according to a behavior and the stature of the virtual character 20 and a state of a user according to the present embodiment. Here, a scenario is assumed that, for example, in a case where the user A returns to a station in the neighborhood of its home from the school or the work and is walking toward the home, a virtual character 20 finds and speaks to the user A and returns together.

The virtual character behavior determination section 10*b* starts an event (provision of a sound content) using it as a trigger that it is detected by the state-behavior detection section 10*a* that the user A arrives at the nearest station, exits the ticket gate and begins to walk.

First, such an event is performed that the virtual character 20 finds and speaks to the walking user A as depicted in FIG. 6. In particular, the relative position calculation section 10*d* calculates a location direction of an angle F1 with respect the ear of the user a few meters behind the user A as the xy coordinate positions of the sound source of a sound content V1 ("oh!") of a voice to be reproduced first as depicted at an upper part of FIG. 6.

Then, the relative position calculation section 10*d* calculates the xy coordinate positions of the sound source of a sound content V2 of footsteps chasing the user A such that the xy coordinate positions gradually approach the user A (localization direction of an angle F2 with respect to the ear of the user). Then, the relative position calculation section 10*d* calculates the localization direction of an angle F3 with respect the ear of the user at a position just behind the user A as the xy coordinate positions of the sound source of a sound content V3 of voice ("welcome back").

By calculating the sound image localization position (localization direction and distance with respect to the user) in accordance with the behavior and the lines of the virtual character 20 such that there is no sense of incongruity in a case where it is assumed that the virtual character 20 actually exists and is behaving in the real space in this manner, it is possible to allow a movement of the virtual character 20 to be felt with a higher degree of reality.

Further, the relative position calculation section 10*d* calculates the height of the sound image localization position in response to a part of the virtual character 20 corresponding to the type of the sound content. For example, in a case where the height of the ear of the user is higher than the head of the virtual character 20, the heights of the sound contents V1 and V3 of the voice of the virtual character 20 are lower than the height of the ear of the user as depicted at a lower part of FIG. 6 (lower by an angle G1 with respect to the ear of the user).

Further, since the sound source of the sound content V2 of the footsteps of the virtual character 20 is the feet of the virtual character 20, the height of the sound source is lower than the sound source of the voice (lower by an angle G2 with respect to the ear of the user). In a case where it is supposed that the virtual character 20 actually exists in the real space, by calculating the height of the sound image localization position taking the state (standing, sitting) and the magnitude (stature) of the virtual character 20 into consideration in this manner, it is possible to allow the presence of the virtual character 20 to be felt in a higher degree of reality.

Where the sound to be provided to the user moves in this manner, sound with which an action that allows the user to feel as if the virtual character 20 exists there is performed by the user and reaches the user is provided to the user. Here, such movement of sound, in other words, animation by sound, is suitably referred to as sound image animation.

The sound image animation is a representation for allowing the user to recognize the existence of the virtual character 20 through sound by providing a movement (animation) to the position of the sound image as described hereinabove, and as implementation means of this, a technique called key frame animation or the like can be applied.

By the sound image animation, the series of animation that the virtual character 20 gradually approaches the user from behind (angle F1) of the user and the lines "welcome back" are emitted at the angle F3 as depicted in FIG. 6 is provided to the user.

Although the sound image animation is described below, in the following description, although animation relating to the xy coordinates is described while description of animation relating to the heightwise direction is omitted, similar processing in regard to the xy coordinates can be applied also to that in regard to the heightwise direction.

Figure 7:
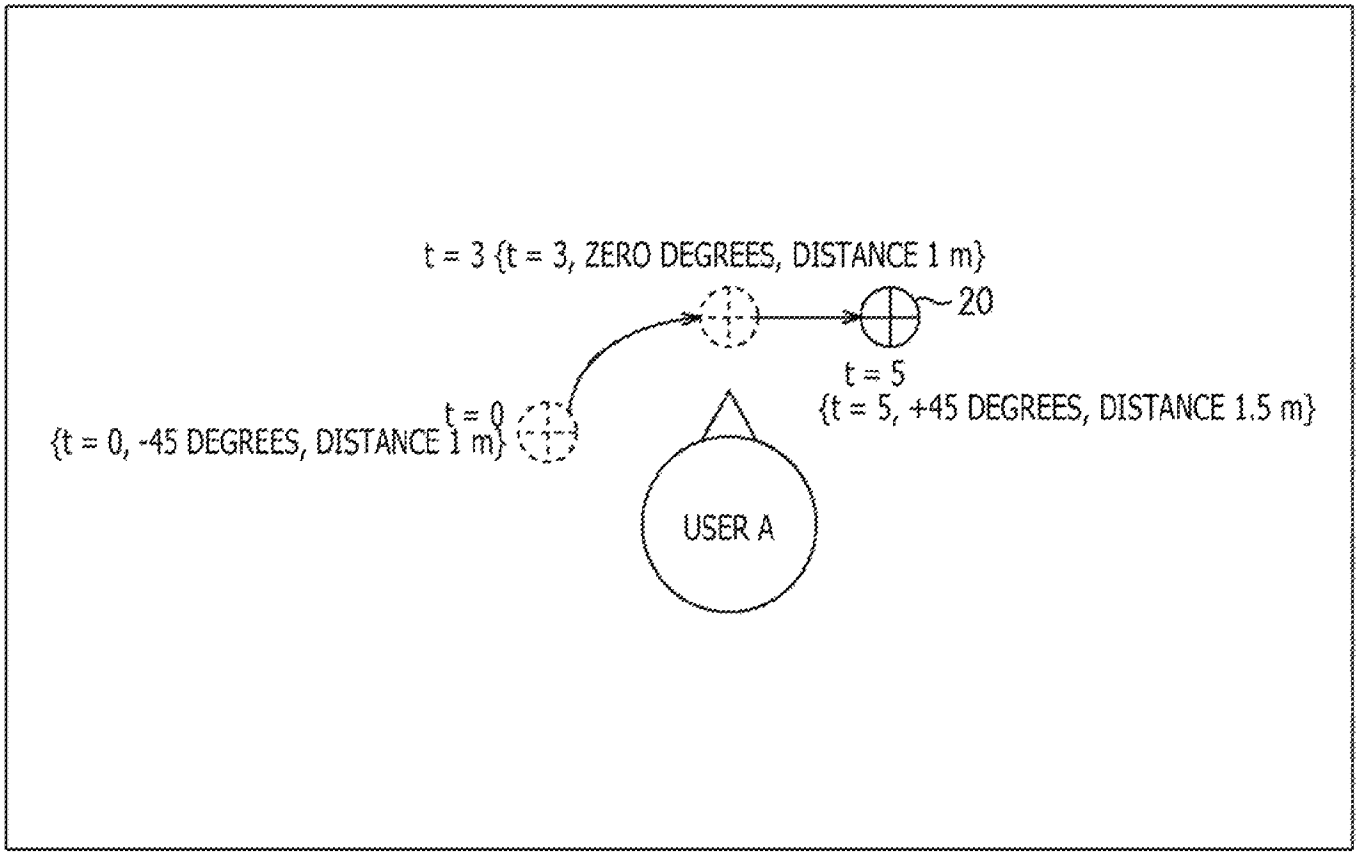
FIG. 7 is a view illustrating sound image animation.

The sound image animation is described further with reference to FIG. 7. In the description given with reference to figures beginning with FIG. 7, it is assumed that the front of the user A is the angle zero degrees and the left side of the user A is the negative side while the right side of the user A is the positive side.

At time t=0, the virtual character 20 is positioned at −45 degrees and the distance of 1 m and is emitting predetermined voice (lines or the like). After time t=0 to time t=3, the virtual character 20 moves to the front of the user A in such a manner as to draw an arc. At time t3, the virtual character 20 is positioned at zero degrees and the distance of 1 m and is emitting predetermined voice (lines or the like).

After time t=3 to time t=5, the virtual character 20 moves to the right side of the user A. At time t=5, the virtual character 20 is positioned at 45 degrees and the distance of 1.5 m and is emitting predetermined voice (lines or the like).

In a case where such sound image animation is provided to the user A, information relating to the position of the virtual character 20 at each time t is described as a key frame. The following description is given assuming that the key frame here is information relating to the position of the virtual character 20 (sound image position information).

In particular, as depicted in FIG. 7, information of the key frame [0]={t=0, −45 degrees, distance 1 m}, key frame [1]={t=3, zero degrees, distance 1 m} and key frame [2]={t=5, +45 degrees, distance 1.5 m} is set and subjected to an interpolation process such that sound image animation exemplified in FIG. 7 is executed.

The sound image animation depicted in FIG. 7 is animation when the lines A are emitted, and emission of the lines B after then is described with reference to FIG. 8.

Figure 8:
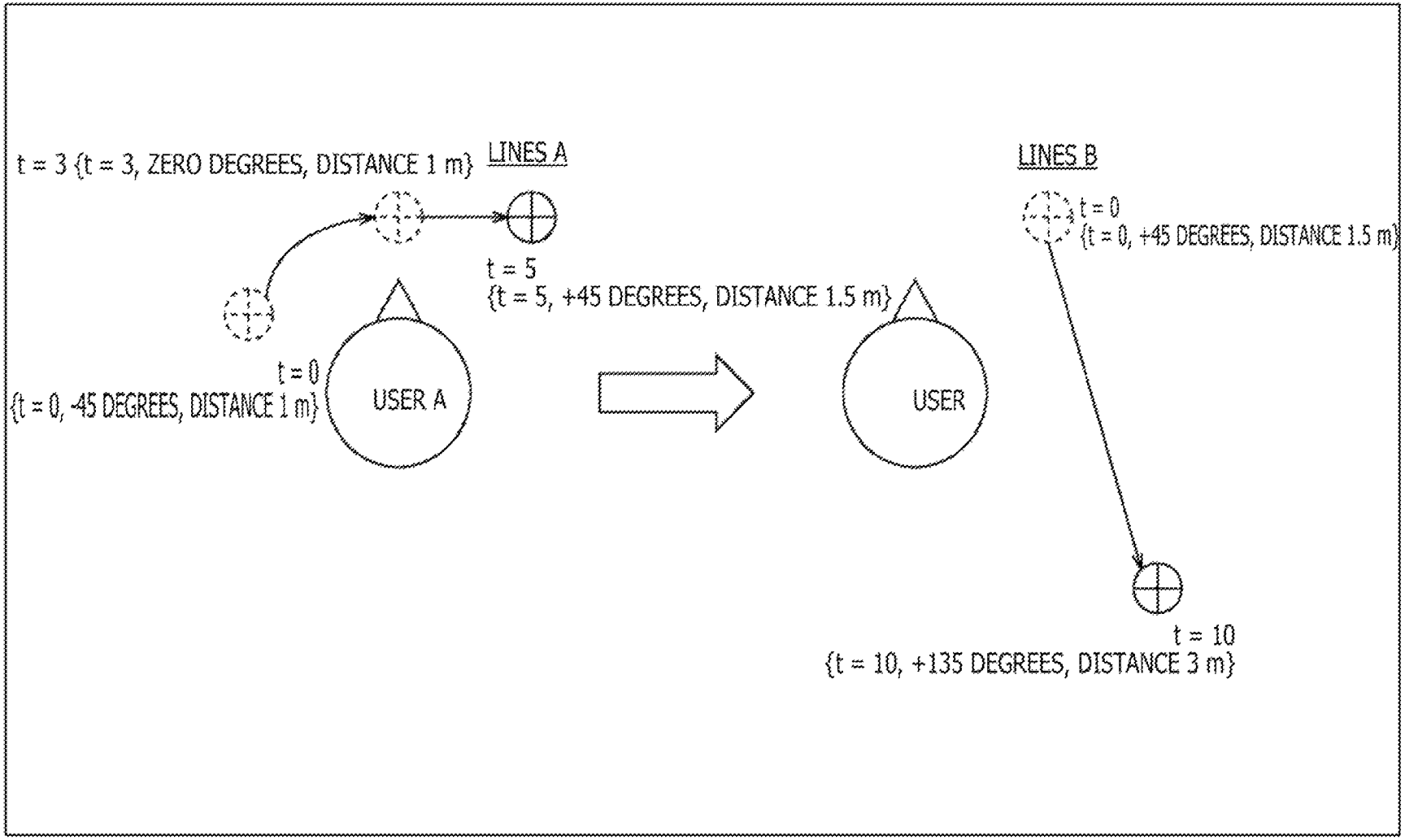
FIG. 8 is a view illustrating sound image animation.

A view depicted on the left side in FIG. 8 is similar to the view depicted in FIG. 7 and depicts an example of sound image animation when the lines A are emitted. After the lines A are emitted, the lines B are emitted successively or after lapse of a predetermined period of time. At the starting point of time (time t=0) of the lines B, information of the key frame [0]={t=0, +45 degrees, distance 1.5 m} is processed, and as a result, the virtual character 20 exists at 45 degrees on the right of the user and at the distance 1.5 m and the utterance of the lines B is started.

At the ending point of time (time t=10) of the lines B, information of the key frame [1]={t=10, +135 degrees, distance 3 m} is processed, and as a result, the virtual character 20 exists at 135 degrees right of and 3 m away from the user and the utterance of the lines B is ended. Since such sound image animation is executed, the virtual character 20 who is uttering the lines B while moving from the right front to the right rear of the user A can be expressed.

Incidentally, if the user A does not move, especially, in this case, if the head does not move, then the sound image moves in accordance with an intention of a creator who created the sound image animation and utterance of the lines B is started from the ending position of the lines A, and such a sense that the virtual character 20 is moving can be provided to the user A. Here, referring back to FIGS. 1 and 2, the information processing apparatus 1 is configured such that, where the information processing apparatus 1 to which the present technique is applied is mounted on the head (neck) of the user A and moves together with the user A, it can implement such a situation that the user A enjoys entertainment on the information processing apparatus 1 while exploring a wide area together for a longer period of time.

Therefore, when the information processing apparatus 1 is mounted, it is supposed that the head of the user moves, and where the head of the user moves, there is the possibility that the sound image animation described with reference to FIG. 7 or 8 may not be able to be provided as intended by the creator. This is described with reference to FIGS. 9 and 10.

Figure 9:
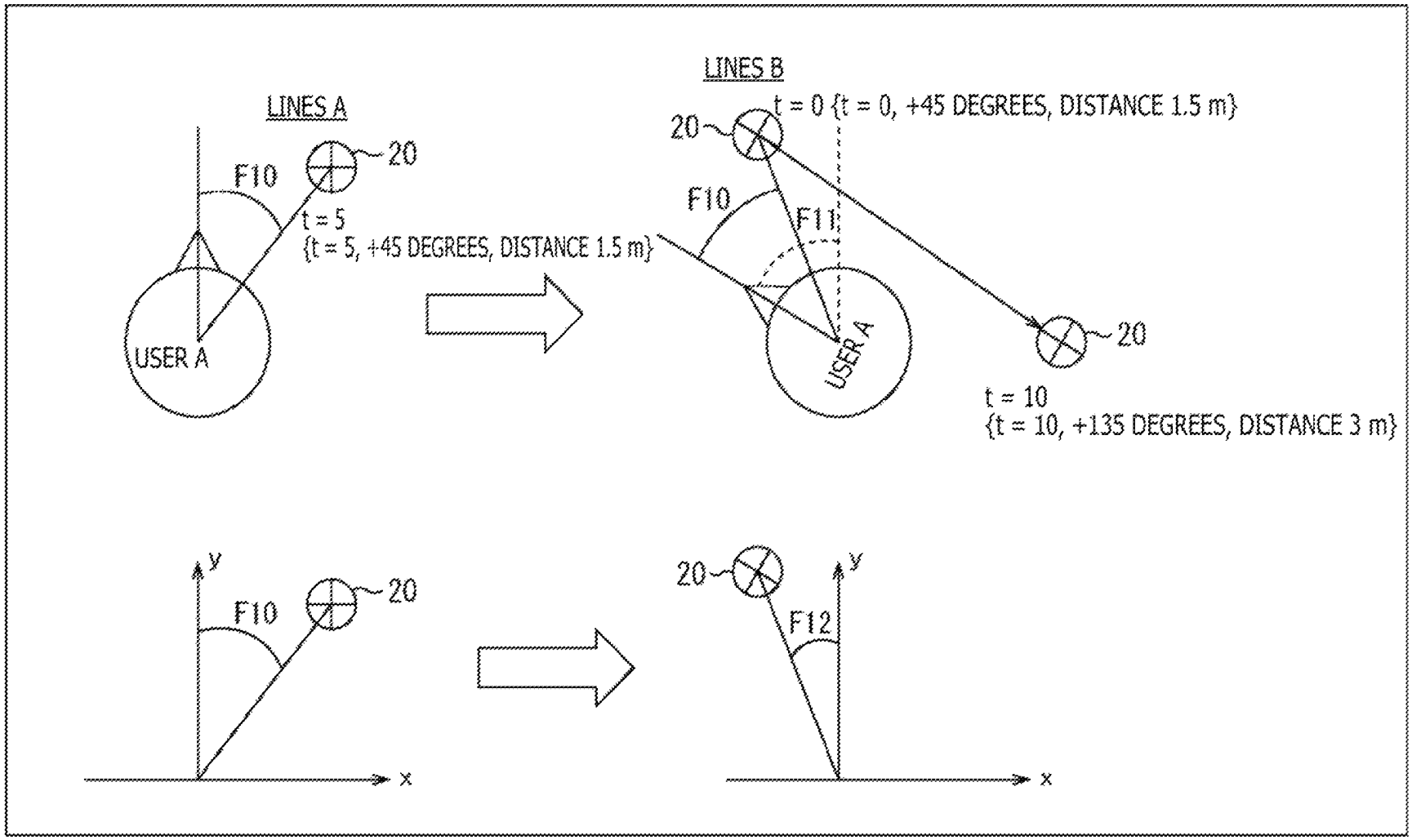
FIG. 9 is a view illustrating sound image animation.

It is assumed that, when the head of the user A of the sound image moves, at the ending time of the lines A, in the leftward direction by an angle F11 from a state in which the sound image is positioned at the angle F10 (+45 degrees) with respect to the user A as depicted in a left upper view in FIG. 9, the lines B are started. In this case, the sound image is localized to the direction of +45 degrees with respect to zero degrees given by the front of the user A on the basis of the information of the key frame [0], and the lines B are started.

This is described with reference to a lower view in FIG. 9 in regard to the position of the virtual character 20 in the real space (space in which the user actually is) assuming that the virtual character 20 is in the real space. It is to be noted that, in the following description, the position of the virtual character 20 with respect to the user is referred to as relative position, and the position of the virtual character 20 in the real space is referred to as absolute position.

The following description is given assuming that a coordinate system for a relative position (hereinafter referred to suitably as relative coordinate system) is a coordinate system where the center of the head of the user A is x=y=0 (hereinafter referred to as center point) and the front direction of the user A (direction in which the nose exists) is the y axis and is a coordinate system fixed to the head of the user A. Therefore, in the relative coordinate system, even if the user A moves its head, the front direction of the user A is the coordinate system having the angle of zero degrees.

The coordinate system for an absolute position (hereinafter referred to suitably as absolute coordinate system) is a coordinate system where the center of the head of the user A at a certain point of time is x=y=0 (hereinafter referred to as center point) and the front direction of the user A (direction in which the nose exists) is the y axis. However, description is given assuming that the absolute coordinate system is a coordinate system that is not fixed to the head of the user A but is fixed to the real space. Therefore, in the absolute coordinate system, the absolute coordinate system set at a certain point of time is a coordinate system in which, even if the user A moves its head, the axial directions do not change in accordance with the movement of the head but are fixed in the real space.

Referring to a left lower view in FIG. 9, the absolute position of the virtual character 20 at the time of the end of the lines A is the direction of an angle F10 when the head of the user A is the center point. Referring to a right lower view in FIG. 9, the absolute position of the virtual character 20 at the time of the start of the lines B is the direction of an angle F12 from the center point (x=Y=0) on the absolute coordinate system same as the coordinate system at the time of the end of the lines A.

For example, in a case where the angle F10 is +45 degrees and the angle F11 over which the head of the user moves is 70 degrees, since the position (angle F12) of the virtual character 20 on the absolute coordinate system is the difference of 35 degrees, which is on the negative side, as viewed in a right lower view in FIG. 9, the position is −35 degrees.

In this case, although, at the time of the end of the lines A, the virtual character 20 was at the place of the angle F10 (=45 degrees) on the absolute coordinate system, at the time of the start of the lines B, the virtual character 20 is at the angle F12 (=−35 degrees) on the absolute coordinate system. Therefore, the user A recognizes that the virtual character 20 has momentarily moved from the angle F10 (=45 degrees) to the angle F12 (=−35 degrees).

Furthermore, in a case where sound image animation is set at the time of utterance of the lines B, for example, in a case where sound image animation for such lines B as described hereinabove with reference to FIG. 8 is set, sound image animation that the virtual character 20 moves from the angle F10 by the relative position (angle F12 by the absolute position) to the relative position defined by the key frame [1] as viewed in a left upper view in FIG. 9.

In this manner, in a case where the creator of the sound image animation intends that the lines B are to be emitted from the direction of right +45 degrees of the user A irrespective of the direction of the face of the user A, such processes as described above are executed. In other words, the creator of sound image animation can create a program such that a sound image is positioned at an intended position by a relative position.

Figure 10:
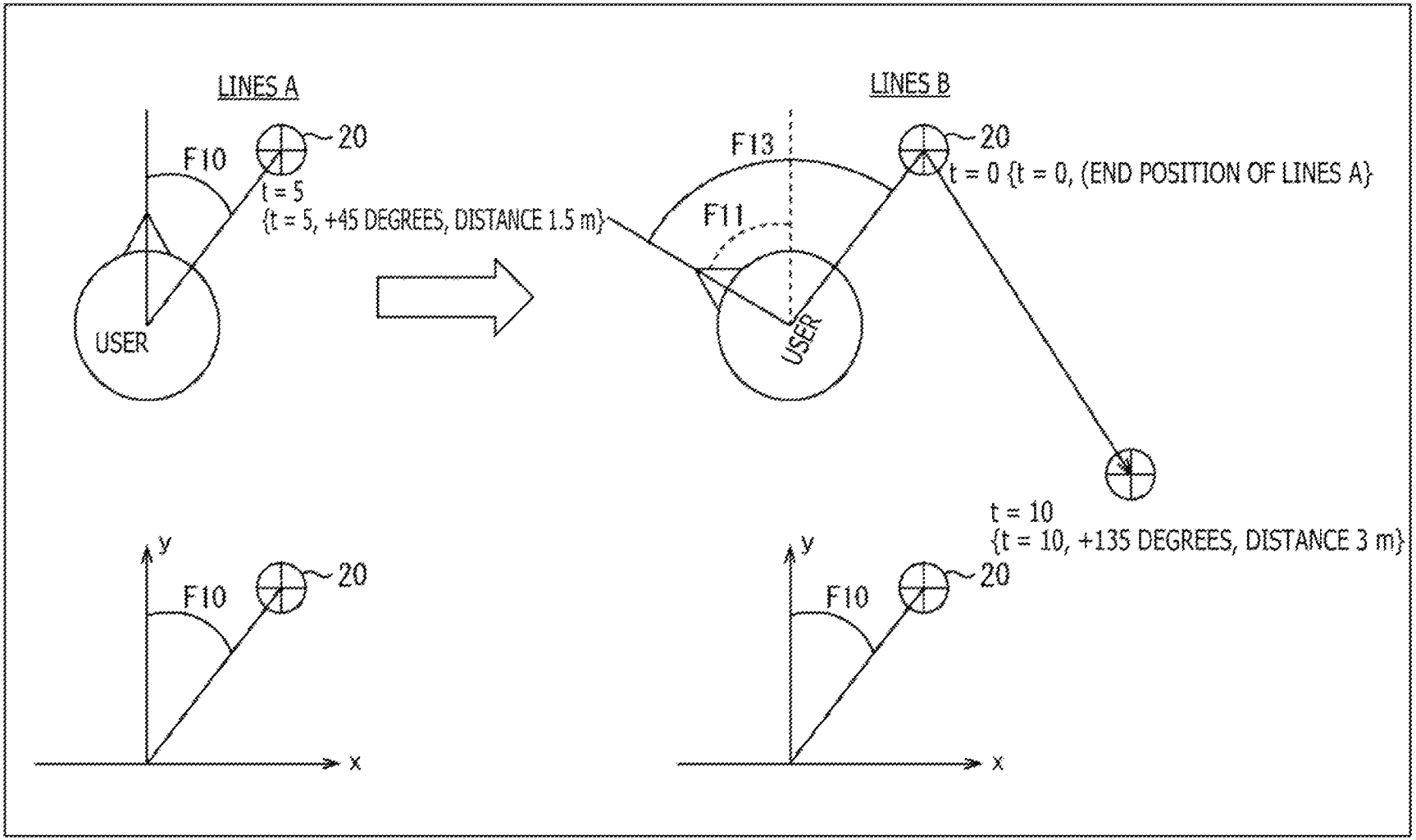
FIG. 10 is a view illustrating sound image animation.

On the other hand, in a case where it is desired to provide the user A with such a recognition that the lines B are emitted while the virtual character 20 does not move from the ending spot of the lines A, in other words, in a case where it is desired to provide the user A with such a recognition that the lines B are emitted in a state in which the virtual character 20 is fixed (not moved) in the real space, a process following up a movement of the head of the user A is performed as described with reference to FIG. 10.

It is assumed that, as depicted in a left upper view in FIG. 10, the lines B are started when the head of the user A moves in the leftward direction by the angle F11 from a state in which the sound image is positioned at the angle F10 (+45 degrees) with respect to the user A at the time of the end of the lines A. During a period after the time of the end of the lines A to the time of the start of the lines B (while the voice changes over from the lines A to the lines B), the movement of the head of the user A is detected and the amount and the direction of the movement are detected. It is to be noted that, also during utterance of the lines A and the lines B, the amount of movement of the user A is detected.

Upon starting of the utterance of the lines B, the position of the sound image of the virtual character 20 is set on the basis of the amount of movement of the user A and information of the key frame [0] at the point of time. Referring to a right upper view in FIG. 10, in a case where the user A changes its orientation by the angle F11, such setting of the sound image that the virtual character 20 is at the position of an angle F13 by a relative position is performed. The angle F13 has a value of the sum of the angle with which the angle F11 that is the amount of movement of the user A is cancelled and the angle defined by the key frame [0].

Referring to a right lower view in FIG. 10, the virtual character 20 is at the position of the angle F10 in the real space (real coordinate system). This angle F10 is a position same as the position at the point of time of the end of the lines A depicted in the left lower view in FIG. 10 as a result of addition of the value for cancelling the amount of movement of the user A. In this case, the relationship of the angle F13−angle F11=angle F10 is satisfied.

By detecting the amount of movement of the user A and performing a process for cancelling the amount of movement in this manner, such a sense that the virtual character 20 is fixed in the real space can be provided to the user A. It is to be noted that, although details are hereinafter described, in a case where it is desired such that the end position of the lines A becomes the start position of the lines B in this manner, the key frame [0] at time t=0 of the lines B is defined as key frame [0] {t=0, (end position of lines A)} as depicted in FIG. 10.

In a case where a key frame is not set after time t=0 at the time of the start of the lines B, the virtual character 20 continues the utterance of the lines B at the position at the point of the start of the lines B.

In a case where a key frame is set after time t=0 at the time of the start of the lines B, in other words, in a case where sound image animation is set at the time of utterance of the lines B, for example, in a case where sound image animation same as such sound image animation for the lines B as described hereinabove above with reference to FIG. 8 is set, sound image animation is executed in which the virtual character 20 moves from the angle F13 at the relative position (angle F10 at the absolute position) to the relative position defined in the key frame [1] as depicted in a left upper view in FIG. 10.

In a case where the creator of the sound image animation intends that the position of the virtual character 20 in the real space is fixed and the lines B are emitted irrespective of the orientation of the face of the user A, such processes as described above are performed. In other words, the creator of the sound image animation can create a program such that the sound image is positioned at a position intended by an absolute position.

<Content>

Figure 11:
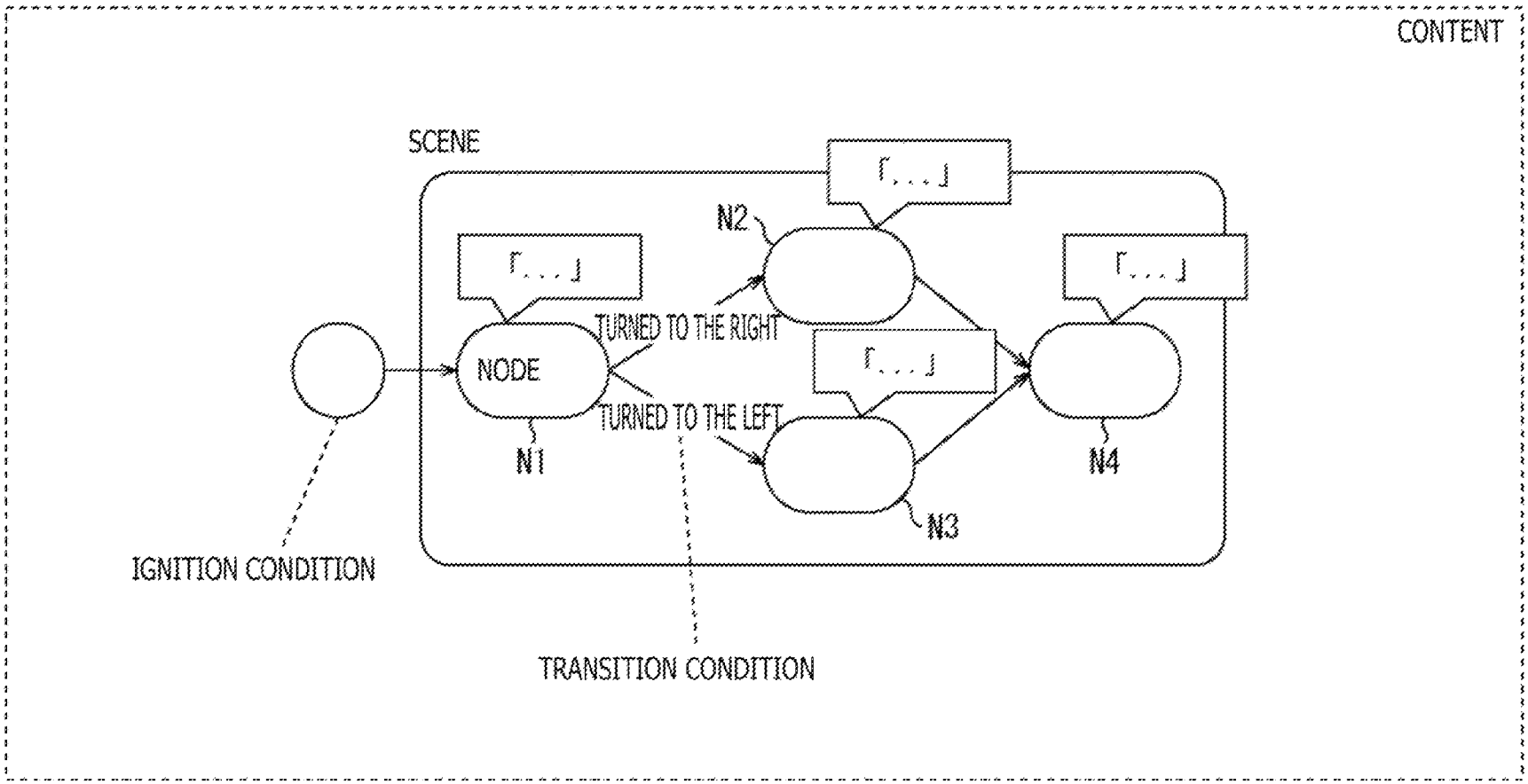
FIG. 11 is a view illustrating content.

Here, content is described. FIG. 11 is a view depicting a configuration of content.

Content includes a plurality of scenes. Although FIG. 11 depicts such that the content includes only one scene for the convenience of description, a plurality of scenes are prepared for each scene.

When a predetermined ignition condition is satisfied, a scene is started. The scene is a series of processing flows that occupy the time of the user. One scene includes one or more nodes. The scene depicted in FIG. 11 indicates an example in which it includes four nodes N1 to N4. A node is a minimum execution processing unit.

If a predetermined ignition condition is satisfied, then processing by the node N1 is started. For example, the node N1 is a node that perform a process for emitting lines A. After the node N1 is executed, transition conditions are set, and depending upon the satisfied condition, the processing advances to the node N2 or the node N3. For example, in a case where the transition condition is a transition condition that the user turns to the right and this condition is satisfied, the processing transits to the node N2, but in a case where the transition condition is a transition condition that the user turns to the left and this condition is satisfied, the processing transits to the node N3.

For example, the node N2 is a node for performing a process for emitting the lines B, and the node N3 is a node for performing a process for emitting the lines C. In this case, after the lines A are emitted by the node N1, an instruction waiting state from the user (waiting condition until the user satisfies a transition condition) is entered, and in a case where an instruction from the user is made available, a process by the node N2 or the node N3 is executed on the basis of the instruction. When a node changes over in this manner, changeover of lines (voice) occurs.

After the process by the node N2 or the node N3 ends, the processing transits to the node N4 and a process by the node N4 is executed. In this manner, a scene is executed while the node changes over successively.

A node has an element as an execution factor in the inside thereof, and for the element, for example, "voice is reproduced," "a flag is set" and "a program is controlled (ended or the like)" are prepared.

Here, description is given taking an element that generates voice as an example.

FIG. 12 is a view illustrating a setting method of a parameter or the like configuring a node. In the node (Node), "id," "type," "element" and "branch" are set as the parameters.

"id" is an identifier allocated for identifying the node and is information to which "string" is set as a data type. In a case where the data type is "string," this indicates that the type of the parameter is a letter type.

"element" is information in which "DirectionalSoundElement" or an element for setting a flag is set and "Element"

is set as a data type. In a case where the data type is "Element," this indicates that the data type is a data structure defined by the name of Element. "branch" is information in which a list of transition information is described and "Transition[ ]" is set as a data type.

To this "Transition[ ]," "target id ref" and "condition" are set as parameters. "target id ref" is information in which an ID of a node of a transition destination is described and "string" is set as a data type. "condition" is information in which a transmission condition, for example, a condition that "the user turns to the rightward direction" is described and "Condition" is set as a data type.

In a case where "element" of a node is "DirectionalSoundElement," "DirectionalSoundElement (extends Element)" is referred to. It is to be note here that, although "DirectionalSoundElement" is depicted and described, in addition to the "DirectionalSoundElement," for example, also "FlagElement" for operating a flag is available, and in a case where "element" of the node is "FlagElement," "FlagElement" is referred to.

"DirectionalSoundElement" is an element relating to sound, and such parameters as "stream id," "sound id ref," "keyframes ref" and "stream id ref" are set.

"stream id" is an ID of the element (identifier for identifying "DirectionalSoundElement") and is information in which "string" is set as the data type.

"sound id ref" is an ID of sound data (sound file) to be referred to and is information in which "string" is set as a data type.

"keyframes ref" is an ID of an animation key frame and is information that represents a key in "Animations" hereinafter described with reference to FIG. 13 and "string" is set as a data type.

"stream id ref" is "stream id" designated to different "DirectionalSoundElement" and is information in which "string" is set as a data type.

It is essentially required that one or both of "keyframes ref" and "stream id ref" are designated in "DirectionalSoundElement." In particular, three patterns are available including a pattern of a case in which only "keyframes ref" is designated, another pattern of a case in which only "stream id ref" is designated and a further pattern of a case in which "keyframes ref" and "stream id ref" are designated. The manner of setting of a sound image position when a node transits differs depending upon each pattern.

Although details are hereinafter described again, in a case where only "keyframes ref" is designated, for example, a position of a sound image upon starting of lines is set on a relative coordinate system fixed to the head of the user as described hereinabove with reference to FIG. 8 or 9.

On the other hand, in a case where only "stream id ref" is designated, for example, a position of a sound image upon starting of lines is set on an absolute coordinate system fixed to the real space as described hereinabove with reference to FIG. 10.

Further, in a case where both of "keyframes ref" and "stream id ref" are designated, as described hereinabove with reference to FIG. 10, the position of the sound image upon starting of lines is set on the absolute coordinate system fixed to the real space, and thereafter, sound image animation is provided.

The positions of the sound image are hereinafter described, and before the description, "Animations" is described. A setting method of key frame animation is described with reference to FIG. 13.

Key frame animation is defined by "Animations" including a parameter called "Animation ID," and "Animation ID" represents a keyframes array using an animation ID as a key and has "keyframe[ ]" set therein as a data type. This "keyframe[ ]" has set therein "time," "interpolation," "distance, "azimuth," "elevation," "pos x," "pos Y" and "pos z" as parameters.

"time" represents elapsed time [ms] and is information in which "number" is set as a data type. "interpolation" represents an interpolation method to next KeyFrame, and such methods as depicted, for example, in FIG. 14 are set in "interpolation." Referring to FIG. 14, to "interpolation," "NONE," "LINEAR," "EASE IN QUAD," "EASE OUT QUAD," "EASE IN OUT QUAD" and so forth are set.

"NONE" is set in a case where no interpolation is to be performed. That no interpolation is performed signifies setting that the value of the current key frame is not changed till time of a next key frame. "LINEAR" is set in a case where a linear interpolation is to be performed.

"EASE IN QUAD" is set when interpolation is to be performed by a quadratic function such that the outset is smoothened. "EASE OUT QUAD" is set when interpolation is to be performed by a quadratic function such that the termination is smoothened. "EASE IN OUT QUAD" is set when interpolation is to be performed by a quadratic function such that the outset and the termination are smoothened.

In addition to those described above, various interpolation methods are set in "interpolation."

Returning back to the description of KeyFrame depicted in FIG. 13, "distance," "azimuth" and "elevation" are information to be described when a polar coordinate system is used. "distance" represents the distance [m] from its own (information processing apparatus 1) and is information in which "number" is set as the data type.

"azimuth" represents a relative direction [deg] from its own (information processing apparatus 1) and is a coordinate for which the front is set to zero degrees and the right side is set to +90 degrees while the left side is set to −90 degrees and further is information in which "number" is set as a data type. "elevation" represents an elevation angle [deg] from the ear and is a coordinate for which the upper side is in the positive and the lower side is in the negative, and further is information in which "number" is set as a data type.

"pos x, "pos y" and "pos z" are information that is described when the Cartesian coordinate system is used. "pos x" represents a left/right position [m] where its own (information processing apparatus 1) is zero and the right side is in the positive and is information in which "number" is set as a data type. "pos y" represents a front/back position [m] where its own (information processing apparatus 1) is zero and the front side is in the positive and is information in which "number" is set as a data type. "pos z" represents an upper/lower position [m] where its own (information processing apparatus 1) is zero and the upper side is in the positive and is information in which "number" is set as a data type.

For example, referring to FIG. 10 again, the key frame depicted at the location of time t=5 of the lines A indicates an example in which "time" is set to "5," "azimuth" is set to "+45 degrees," and "distance" is set to "1." It is to be noted here that description relating to the heightwise direction is merely omitted as described hereinabove, but actually, also information relating the heightwise direction is described in the key frame.

In KeyFrame, one of a polar coordinate system indicated by "distance," "azimuth" and "elevation" and a Cartesian coordinate system indicated by "pos x," "pos y" and "pos z" is designated without fail.

Now, the three patterns in the cases where only "keyframes ref" is designated, in a case where "stream id ref" is designated and where "keyframes ref" and "stream id ref" are designated are described including the foregoing description given with reference to FIGS. 7 to 10 are described.

<Image Sound Position in One Reproduction Interval>

First, an image sound position in one reproduction interval is described. One reproduction interval is an interval during which, for example, the lines A are reproduced and is an interval when one node is processed.

Figure 15:
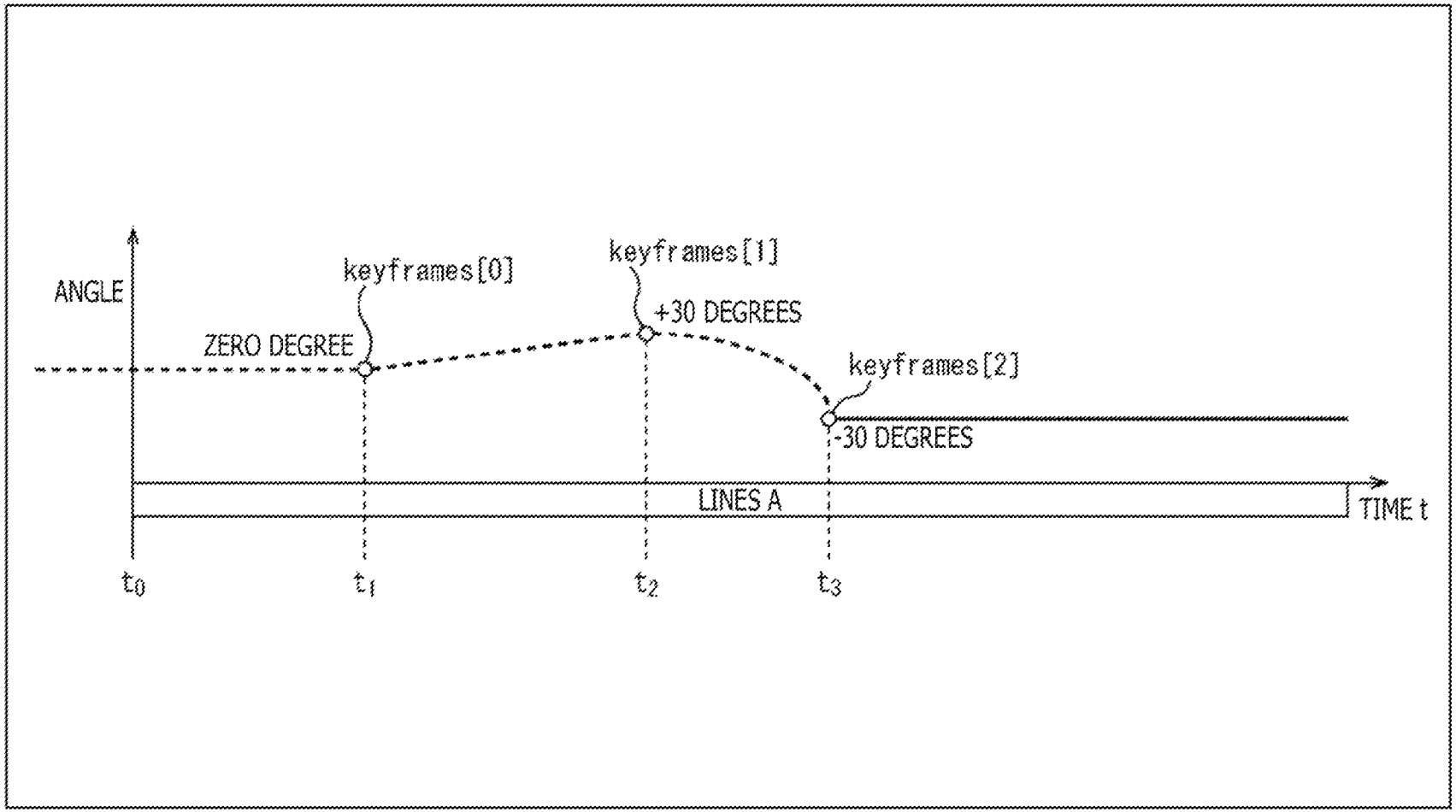
FIG. 15 is a view illustrating sound image animation.

First, a movement designated by a key frame is described with reference to FIG. 15. The axis of abscissa of a graph depicted in FIG. 15 represents time t, and the axis of ordinate represents the angle in the left/right direction. At time to, utterance of the lines A is started.

At time t1, keyframes[0] is set. At time before this keyframes[0], here, during a period from time t0 to time t1, a value of the top KeyFrame, in this case, a value of keyframes[0], is applied. In the example depicted in FIG. 15, at keyframes[0], the angle is set to zero degrees. Thus, such setting that a sound image is localized at a position changed by zero degrees in direction with reference to the angle at time t0 is performed.

At time t2, keyframes[1] is set. At this keyframes[1], the angle is set to +30 degrees. Therefore, setting is performed such that a sound image is localized at a position changed by +30 degrees in direction with reference the angle at time t0.

During a period from this keyframes[0] to keyframes[1], interpolation is performed on the basis of "interpolation." In the example depicted in FIG. 15, "interpolation" set during the period from keyframes[0] to keyframes[1] indicates interpolation in the case of interpolation of "LINEAR."

At time t3, keyframes[2] is set. At this keyframes[2], the angle is set to −30 degrees. Therefore, such setting that a sound image is localized at a position changed by −30 degrees in direction with reference to the angle at time to.

FIG. 15 depicts a case in which, during a period from this keyframes[1] to keyframes[2], "interpolation" is "EASE IN QUAD."

At final Keyframes, in this case, at time later than keyframes[2], a value of final KeyFrame is applied.

In this manner, a position of the virtual character 20 (sound image position) is set by a key frame and the position of the sound image moves on the basis of such setting to implement sound image animation.

Figure 16:
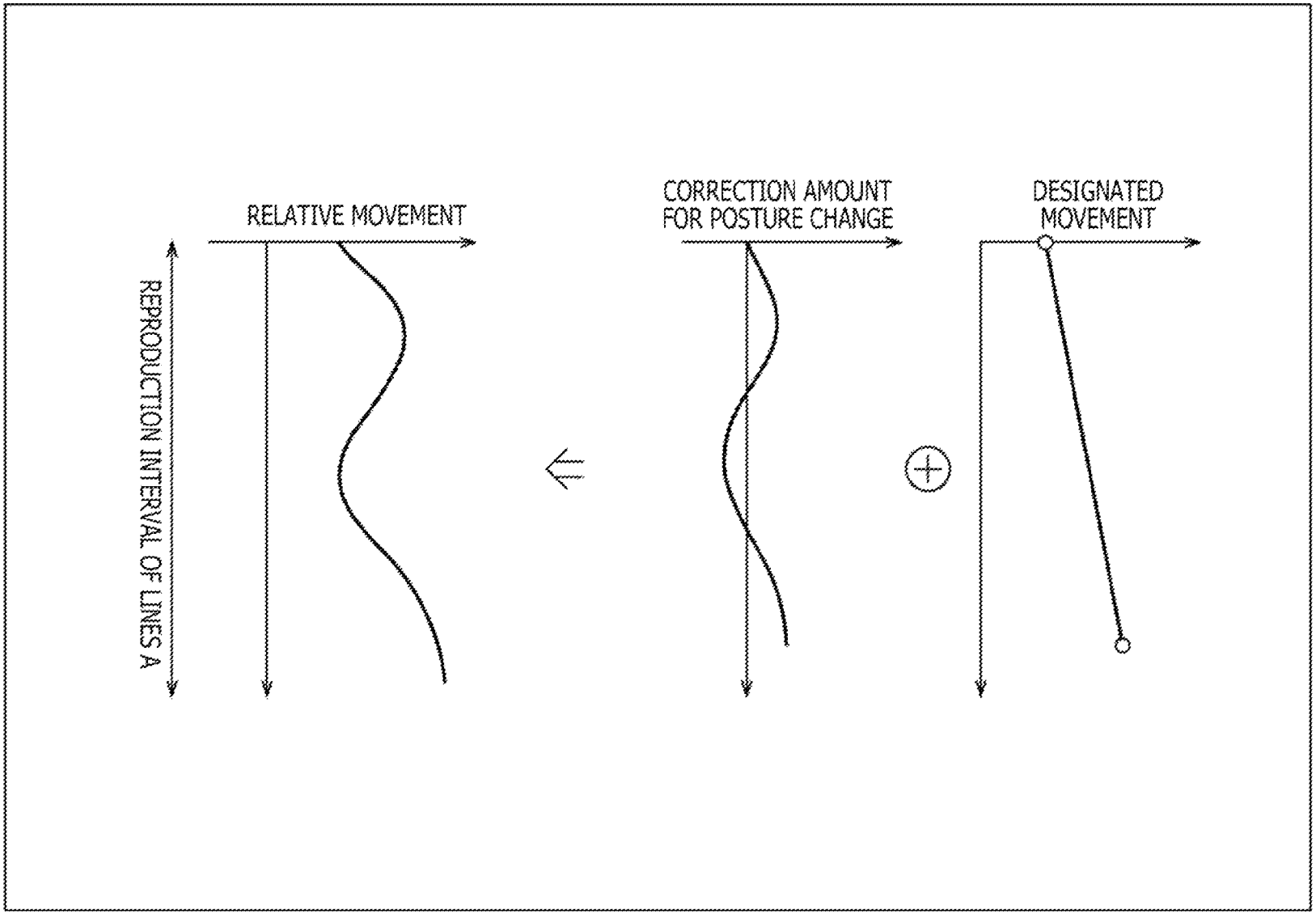
FIG. 16 is a view illustrating sound image animation.

Description is further given of a sound image position with reference to FIG. 16. A graph depicted in an upper view in FIG. 16 is a graph representative of a designated movement, and a graph depicted in a middle view is a graph representative of a correction amount for a posture change while a graph depicted in a lower view is a graph representative of a relative movement.

The axis of abscissa depicted in FIG. 16 represents lapse of time and represents a reproduction interval of the lines A. The axis of ordinate represents the position of the virtual character 20, in other words, the position at which a sound image is localized and is an angle in the left/right direction, an angle in the upper/lower direction, a distance or the like. Here, description is given assuming that the axis of abscissa represents an angle in the left/right direction.

Referring to an upper view in FIG. 16, the designated movement is a movement that the sound image gradually moves in the + direction over a period from a timing of start of reproduction to a timing of end of reproduction of the lines A. This movement is designated by the key frame.

The position of the virtual character 20 is not only a position set by a key frame, but a final position is set taking also a movement of the head of the user into consideration. As described with reference to FIGS. 9 and 10, the information processing apparatus 1 detects the movement amount of its own (amount of movement of the user A, here, principally a movement in the left/right direction of the head).

A middle view in FIG. 16 is a graph representative of a correction amount for a posture change of the user A and is a graph indicative of an example of a movement the information processing apparatus 1 detects as a movement of the head of the user A. In the example depicted in the middle in FIG. 16, the user A is first oriented to the left direction (− direction) and then is oriented to the right direction (+ direction) and thereafter is oriented to the left direction (− direction) again, the correction amount therefor is in the + direction first, in the − direction then and thereafter in the + direction again.

The position of the virtual character 20 is a position obtained by addition of the position set in the key frame and the correction value for the posture change of the user (value of the posture change with the sign reversed). Therefore, (the movement of) the relative position of the virtual character 20 while the lines A are reproduced, in this case, the relative position to the user A, is such as depicted in a lower view in FIG. 16.

Now, a case in which the lines A are reproduced and transition to a next node is performed and then the lines B are produced (a case in which changeover from the lines A to the lines B is performed) is considered. At this time, since the position of the virtual character 20 when reproduction of the lines B is to be started or the position of the virtual character 20 after the start differs among a case in which only "keyframes ref" is designated, another case in which only "stream id ref" is designated and a further case in which "keyframes ref" and "stream id ref" are designated, this is described further.

<In a Case where Only "Keyframes Ref" is Designated>

First, a case is described in which only "keyframes ref" is designated for the node when reproduction of the lines B is to be performed.

The case in which only "keyframes ref" is designated is a case in which, in the configuration of the node described hereinabove with reference to FIG. 12, although the parameter "element" of the node (Node) is "DirectionalSoundElement" and an ID of an animation key frame is described in the parameter "keyframes ref" of "DirectionalSoundElement," the parameter "stream id ref" is not set.

Figure 17:
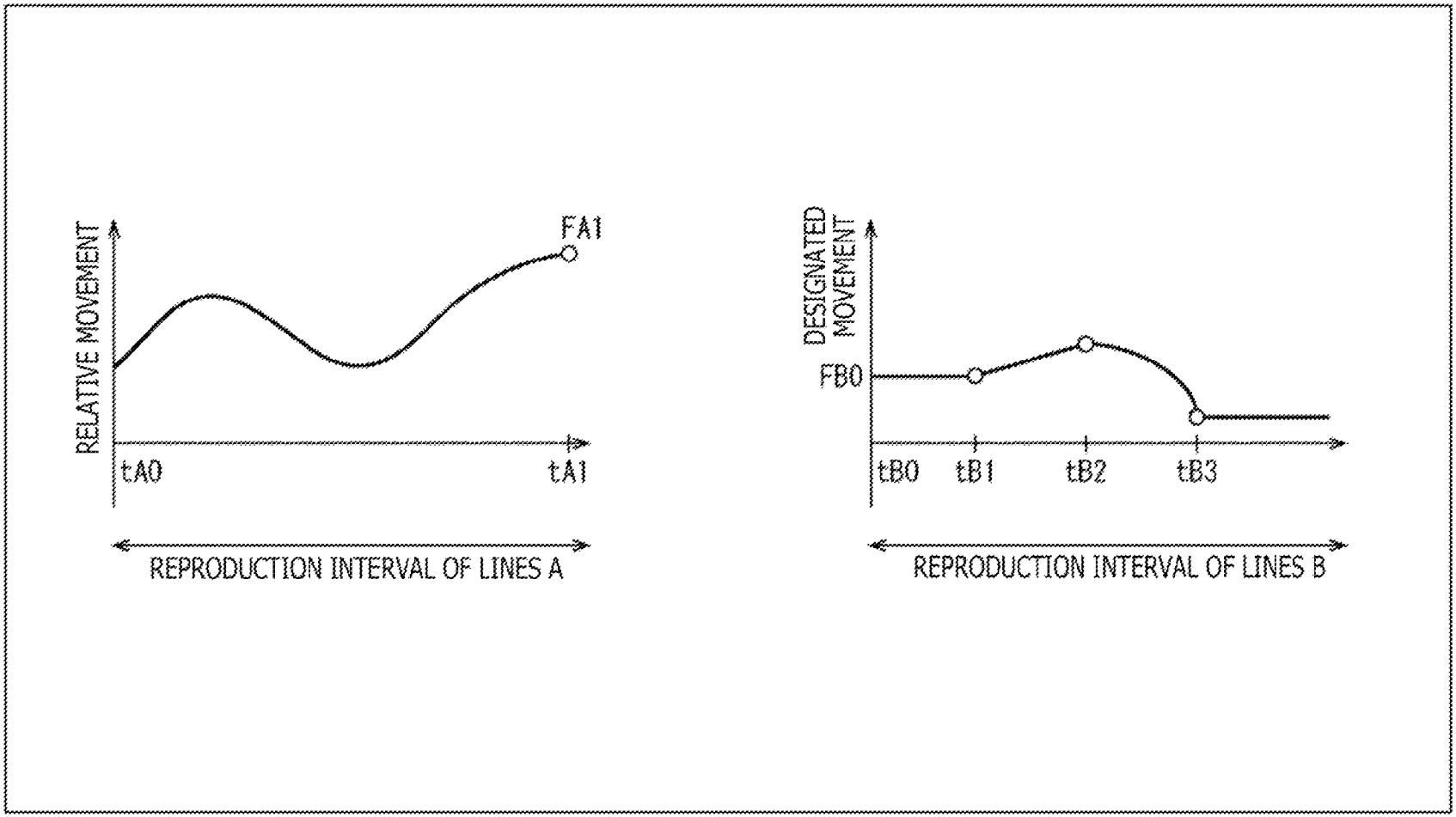
FIG. 17 is a view illustrating takeover of sound.

FIG. 17 is a view illustrating a relative movement of the virtual character 20 to the user A in a case where, when changeover from the node at which the lines A are uttered to the node at which the lines B are uttered is performed (when the sound is to be changed over), only "keyframes ref" is designated for the node of the lines B.

A left view in FIG. 17 is same as the lower view in FIG. 16 and is a graph representing a relative movement of the virtual character 20 within an interval within which the lines A are generated. The relative position of end time tA1 of the lines A is a relative position FA1. A right view in FIG. 17 is same as the upper view in FIG. 16 and is a graph representing elapsed time (axis of abscissa) and a designated movement (axis of ordinate) of the virtual character 20 within the interval within which the lines B are reproduced and represents an example of a movement defined by a key frame.

The relative position of the lines B at start time tB0 is set to a position defined by KeyFrame[0] that is a first key frame set at time tB1. In this case, the node of the lines B refers to "DirectionalSoundElement," and since an ID of the animation key frame is described in the parameter "keyframes ref" of this "DirectionalSoundElement," the animation key frame of this ID is referred to.

In the animation key frame, a position of the virtual character 20 defined by polar coordinates or Cartesian coordinates (in the following description, referred to as coordinates) is described as described hereinabove with reference to FIG. 13.

In particular, in this case, the relative position of the lines B at start time tB0 is set to the coordinates defined in the animation key frame. As depicted in the right view in FIG. 17, the relative position at time tB0 is set to a relative position FB0.

In this case, the position FA1 at the end time of the lines A and the relative position FB0 at the start time of the lines B are sometime different from each other as depicted in FIG. 17. This is such a case as described hereinabove with reference to FIG. 9, and it is possible to allow the virtual character 20 to exist at a position intended by the creator in a relative positional relationship between the user A and the virtual character 20.

In a case where the sound position information "keyframes ref" for setting a position of a sound image of the virtual character 20 is included in a node, it is possible to set the position of a sound image on the basis of the sound image position information included in the node in this manner. Further, by making it possible to perform such setting, it is possible to set a sound image of the virtual character 20 at the position intended by the creator.

In this manner, in a case where only "keyframes ref" is designated in a node when reproduction of the lines B is to be performed, the position of the virtual character 20 can be set such that the relative position of the user A and the virtual character 20 coincides with the intention of the creator. Further, after reproduction of the lines B, sound image animation is provided to the user A on the basis of the key frame.

<In a Case where Only "Stream Id Ref" is Designated>

Now, a case in which only "stream id ref" is designated in a node when reproduction of the lines B is to be performed is described.

The case in which only "stream id ref" is designated is a case in which, although, in the configuration of the node described hereinabove with reference to FIG. 12, the parameter "element" of the node (Node) is DirectionalSoundElement" and stream ID designated to different "DirectionalSoundElement" is described in the parameter "stream id ref" of "DirectionalSoundElement, the parameter "keyframes ref" is not set.

Figure 18:
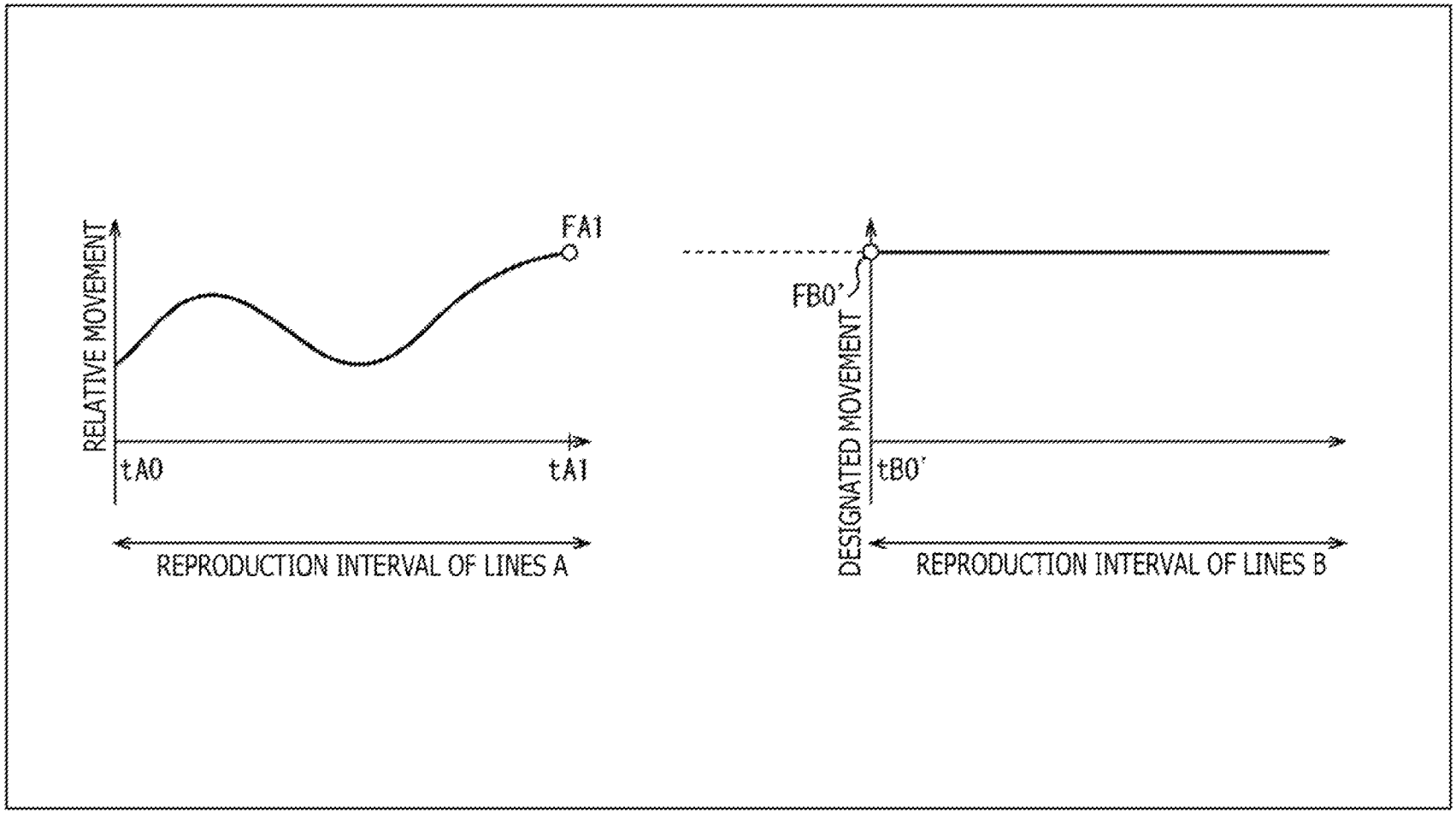
FIG. 18 is a view illustrating takeover of sound.

FIG. 18 is a view illustrating a relative movement of the virtual character 20 to the user A in a case where, when changeover from the node in which the lines A are to be uttered to the node in which the lines B are to be uttered is to be performed, only "stream id ref" is designated in the node of the lines B. A right view in FIG. 18 is a graph representative of elapsed time (axis of abscissa) and a designated movement (axis of ordinate) of the virtual character 20 within an interval within which the lines B are reproduced similarly to the upper view in FIG. 16 and represents an example of a movement defined by the key frame.

A left view in FIG. 18 is same as the left view in FIG. 17 and is a graph representative of a relative movement of the virtual character 20 during the interval within which the lines A are reproduced. The relative position of the lines A at end time tA1 is a relative position FA1.

For the relative position of the lines B at start time tB0', by the parameter "stream id ref" of "DirectionalSoundElement," "DirectionalSoundElement" having stream ID designated by different "DirectionalSoundElement" is referred to. Then, a position FB0' of the lines B at the time of start is set from the position designated by "keyframes" in the "DirectionalSoundElement" and the amount of movement (posture change) of the user A.

For example, in a case where stream ID designated in the different "DirectionalSoundElement" is an ID that refers to the lines A, as the position of the virtual character 20 as viewed from the user A at the point of time of start of the lines B, a position obtained as a result of the "movement designated by the lines A (=keyframe)" and the "posture change of the lines A" is set as the position FB0' at start time tB0' of the lines B.

More particularly, such a key frame that, as the "relative sound image position as viewed from the user A in the lines A" obtained as a result of the "movement designated by the lines A (=keyframe)" and the "posture change of the lines A," the position at a point of time at which the lines B are started is a position at time t=0 is generated, and a position FB0' is set on the basis of the key frame. The "movement designated by the lines A (=keyframe)" can be acquired by being held by a holding section and referring to the information held in the holding section.

In particular, on the basis of the position at the end time of the lines A and a position that cancels the amount of movement of the user A after the end time of the lines A to the start time of the lines B, such a relative position by which the position at the end time of the lines A becomes the position at the start time of the lines B is calculated. Then, a key frame including the calculated position information is generated. Then, a position FB0' at the start time of the lines B is set on the basis of the generated key frame.

By such setting, the position FB0' of the virtual character 20 at the start time FB0' of the lines B becomes same as the position FA1 of the virtual character 20 at the end time tA1 of the lines A. In particular, as described hereinabove with reference to FIG. 10, the position of the virtual character 20 at the end time of the lines A and the position of the virtual character 20 of the lines B coincide with each other.

In this manner, in a case where only "stream id ref" is designated in the node when reproduction of the lines B is to be performed, the position of the virtual character 20 can be set such that the absolute positions of the user A and the virtual character 20 coincide with those intended by the creator. In other words, upon such changeover from the lines A to the line B or the like, it is possible to allow the virtual character 20 to utter lines from the same position without moving in the real space irrespective of the amount of movement of the user A.

For example, as an example of changeover from the lines A to the lines B, a different process is sometimes performed in accordance with an instruction from the user. For example, this is the case in which, for example, the decision process of whether or not a transition condition is satisfied as described hereinabove with reference to FIG. 11 is performed, and is a case in which, when the user turns to the right, processing by the node N2 is executed, but when the user turns to the left, processing by the node N3 is executed. In such a case as just described, a different process (for example, a process based on the node N2 or the node N3) is performed in accordance with an instruction (movement) from the user.

In such a case as just described, there is a period of time for waiting an instruction from the user, and a period of time sometimes appears between the lines A and the lines B. In such a case as just described, in a case where the position at which the lines A are emitted and the position at which the lines B are emitted are different from each other, the user may possibly feel that the virtual character 20 has moved suddenly and have a disagreeable feeling. However, according to the present embodiment, in such a case as changeover from the lines A to the lines B, it is possible to allow the virtual character 20 to emit the lines from a same position without moving in the real space, and therefore, it is possible to prevent the user from having a disagreeable feeling.

In other words, when changeover from the lines A to the lines B is performed, the position at which utterance of the lines B is to be started can be set to a position taking over the position at which the utterance of the lines A is performed. Such setting is possible by designating "stream id ref" at the node when reproduction of the lines B is to be performed. This "stream id ref" is information included in a node when a different node is referred to and the position information of the virtual character 20 (sound image position information) described in the node is used to set a position of the virtual character 20. By including such information into the node, it is possible to execute such processes as described hereinabove.

After the reproduction of the lines B, the lines B are reproduced while the virtual character 20 does not move the start position of the lines B as depicted in a right view in FIG. 18. In this case, since the parameter "keyframes ref" is not set, sound image animation based on the key frame is not executed, and the lines B are reproduced in a state in which the position of the sound image does not change.

It is to be noted that, also during reproduction of the lines B, a posture change of the user A is detected, and since a position of the virtual character 20 is set in response to the posture change, such sound image animation in which it seems that the virtual character 20 does not move in the real space is executed.

Furthermore, in a case where it is desired to provide such sound image animation that, also during reproduction of the lines B, the virtual character 20 is moving, also "keyframes ref" is designated.

<Where "keyframes ref" and "stream id ref" are Designated>

Now, description is given of a case in which "keyframes ref" and "stream id ref" are designated in a node when reproduction of the lines B is performed. Where "keyframes ref" and "stream id ref" are designated, such sound image animation as described with reference to FIG. 10 is implemented.

In a case where "keyframes ref" and "stream id ref" are designated, first, since "keyframes ref" is designated, in the configuration of the node described hereinabove with reference to FIG. 12, the parameter "element" of the node (Node) is "DirectionalSoundElement" and an ID of an animation key frame is described in the parameter "keyframes ref" of "DirectionalSoundElement."

Further, in a case where "keyframes ref" and "stream id ref" are designated, since "stream id ref" is designated, in the configuration of the node described hereinabove with reference to FIG. 12, the parameter "element" of the node (Node) is "DirectionalSoundElement" and a stream ID designated in different "DirectionalSoundElement" is described in the parameter "stream id ref" of the different "DirectionalSoundElement."

Figure 19:
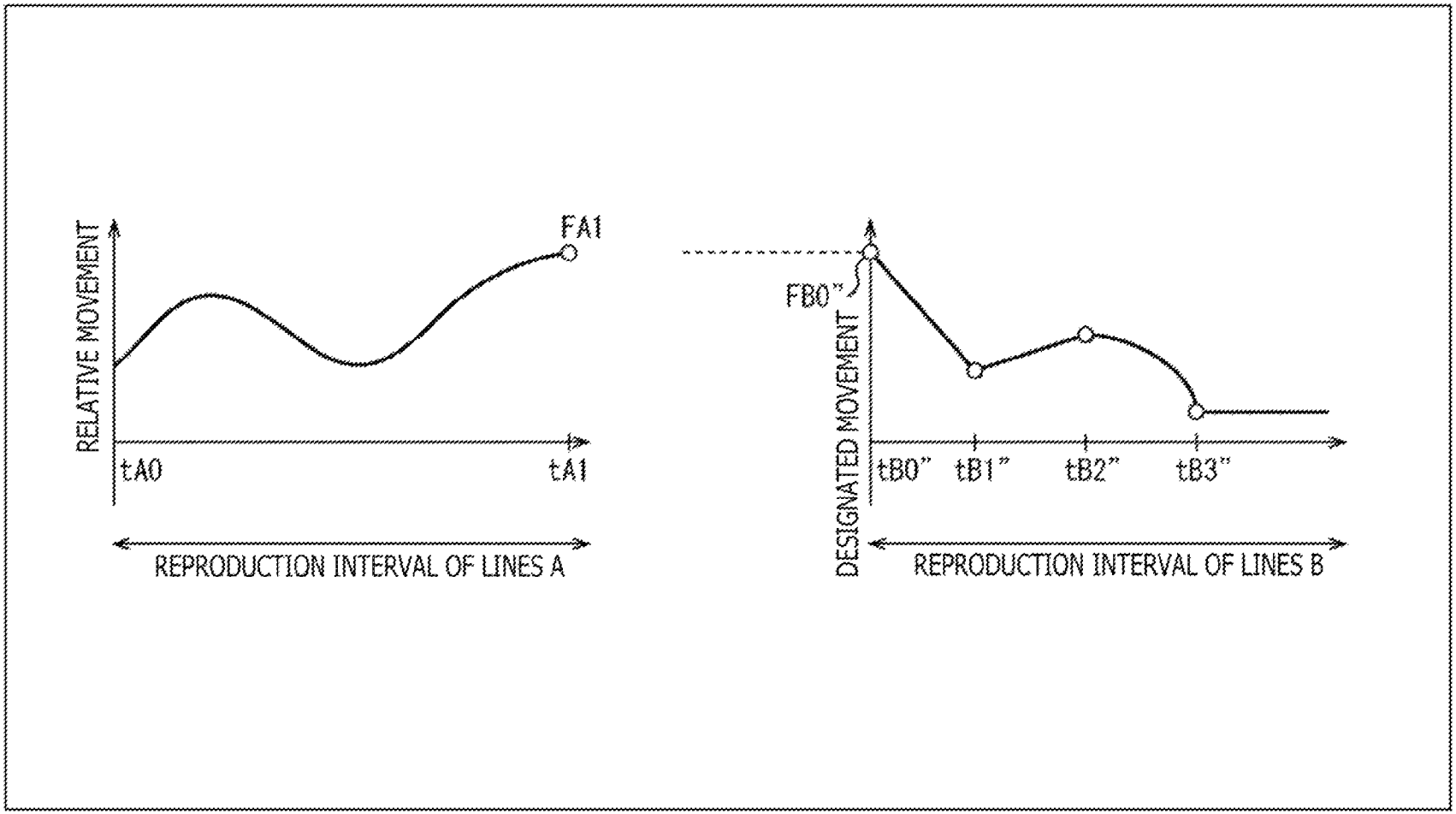
FIG. 19 is a view illustrating takeover of sound.

FIG. 19 is a view illustrating a relative movement of the virtual character 20 to the user A in a case where "keyframes ref" and "stream id ref" are designated in the node of the lines B at the time of changeover from the node for the utterance of the lines A to the node for the utterance of the lines B.

A left view in FIG. 19 is same as the left view in FIG. 17 and is a graph representative of a relative movement of the virtual character 20 in an interval during which the lines A are generated. The relative position at end time tA1 of the lines A is a relative position FA1. A right view in FIG. 19 is a graph representative of elapsed time (axis of abscissa) and a designated movement (axis of ordinate) of the virtual character 20 during an interval during which the lines B are reproduced similarly to the upper view in FIG. 16 and represents an example of a movement defined by a key frame.

A relative position at start time tB0' of the lines B is set by performing similar setting to that in the case described hereinabove with reference to FIG. 18, namely, in a case where only "stream id ref" is designated. In particular, to the parameter "stream id ref" of "DirectionalSoundElement," "DirectionalSoundElement" having stream ID designated in different "DirectionalSoundElement" is referred, and further, a position FB0" at the start time of the lines B is set from the position designated by "keyframes" in the "DirectionalSoundElement" and the amount of movement (posture change) of the user A.

Therefore, as depicted in FIG. 19, the position FB0" of the virtual character 20 at the start time tB0" of the lines B is same as the position FA1 of the virtual character 20 at the end time tA1 of the lines A.

Thereafter, sound image animation is executed depending upon the position set by keyframes[0] designated at time tB1" and an interpolation method. Similarly as in the case described hereinabove with reference to FIG. 17, the relative position FB1" at time tB1" of the lines B is set to a position defined by keyframes[0] that is a key frame set to time tB1."

In this case, since the node of the lines B refers to the "DirectionalSoundElement" and an ID of the animation key frame is described in the parameter "keyframes ref" of the "DirectionalSoundElement," this animation key frame of the ID is referred to.

The relative position of the virtual character 20 at time tB1" is set to coordinates set in the animation key frame referred to. After time tB1," the position defined by the key frame is set to execute sound image animation.

Setting of the position FB0" of the virtual character 20 at time tb0" is further described. The two following patterns are available for setting of the position FB0." The first pattern is a case in which time of keyframes[0] is time=0, and the second pattern is a case in which time of keyframes [0] is later than time >0.

In a case where time of keyframes[0] is time=0, the position itself having been designated by keyframes[0] is replaced with the position FB0." Since the position itself designated by keyframes[0] is replaced with the position FB0," the position of the virtual character 20 at the start time tB0' of the lines B becomes the position FB0."

In a case where time of keyframes[0] is later than time >0, a key frame in which the position of the virtual character 20 of start time tB0' of the lines B is the position FB0" is inserted to the top of key frames set already.

In particular, as keyframes[0] at the start time tB0' of the lines B, keyframes[0] in which the position of the virtual character 20 is defined to the position FB0" is generated and inserted into the top of key frames set already. Since keyframes[0] defined to the position FB0" is generated and inserted in this manner, the position of the virtual character 20 at the start time tB0' of the lines B is the position FB0."

In this manner, in a case where a key frame is inserted into the top, keyframes[n] set already is changed to keyframes [n+1].

In a case where "keyframes ref" and "stream id ref" are designated in this manner, the position of the virtual character 20 at start time of lines is first set on the basis of "stream id ref." At this time, rewriting of a key frame or generation of a new key frame is performed. In this key frame, not only the position of the virtual character 20 but also an interpolation method for next KeyFrame defined by "interpolation" are set. In the example depicted in FIG. 19, a case is depicted in which "LINEAR" is set.

Thereafter, sound image animation is executed on the basis of the set key frame.

<Functions of Control Section>

Functions of the control section 10 (FIG. 3) of the information processing apparatus 1 that performs such processes as described above are described.

Figure 20:
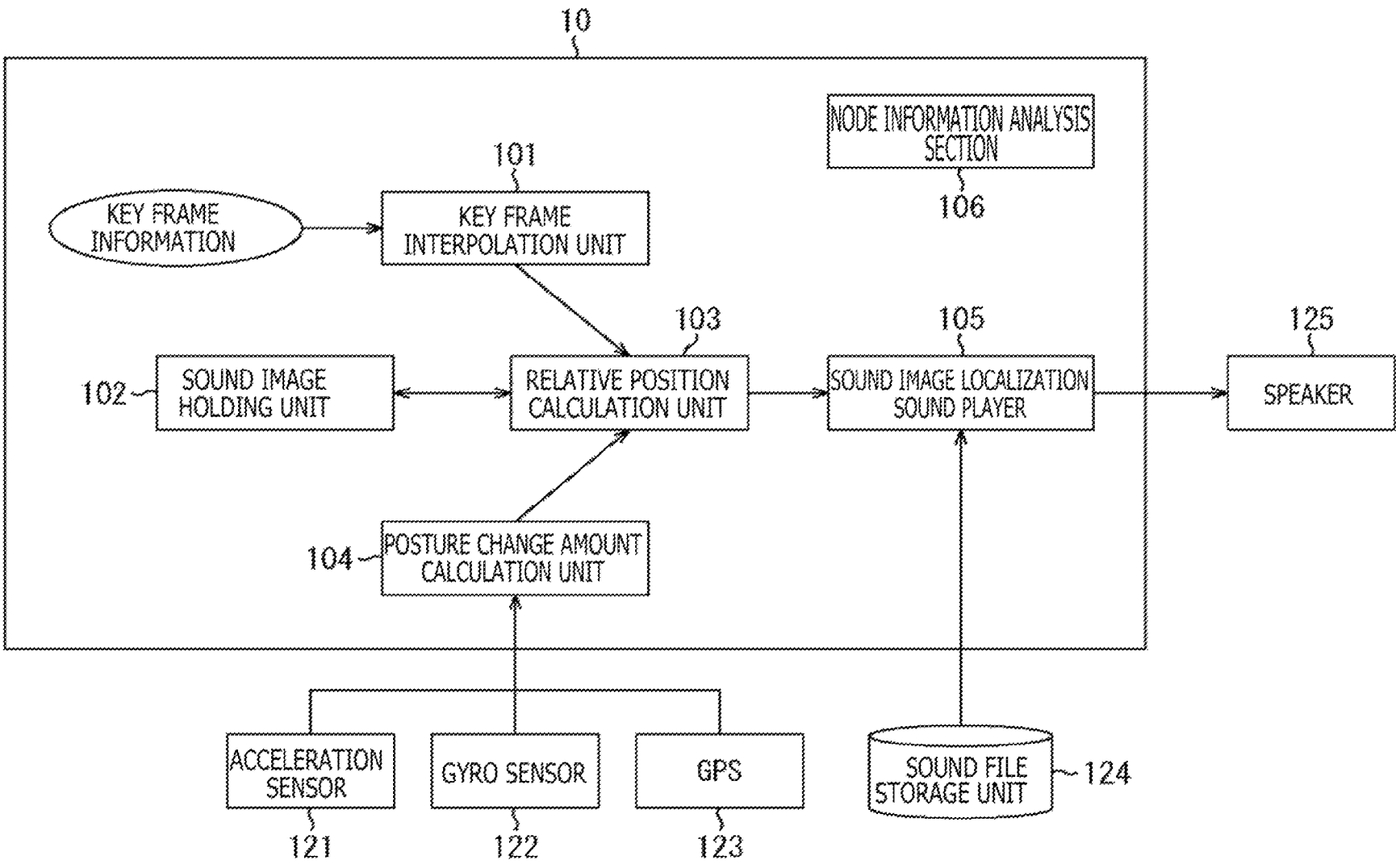
FIG. 20 is a view illustrating a configuration of a control section.

FIG. 20 is a view illustrating functions of the control section 10 of the information processing apparatus 1 that performs the processes described above. The control section 10 includes a key frame interpolation section 101, a sound image position holding section 102, a relative position calculation section 103, a posture change amount calculation section 104, a sound image localization sound player 105 and a node information analysis section 106.

Further, the control section 10 is configured such that information, files and so forth from an acceleration sensor 121, a gyro sensor 122, a GPS 123 and a sound file storage section 124 are supplied thereto. Further, the control section 10 is configured such that a sound signal processed thereby is outputted by a speaker 125.

The key frame interpolation section 101 calculates a sound source position at time t on the basis of the key frame information (sound image position information) and supplies the sound source position to the relative position calculation section 103. To the relative position calculation section 103, also position information from the sound image position holding section 102 and a posture change amount from the posture change amount calculation section 104 are supplied.

The sound image position holding section 102 performs holding and updating of a current position of a sound image to be referred to by "stream id ref." The holding and updating are normally performed independently of processes based on flow charts described with reference to FIGS. 21 and 22.

The posture change amount calculation section 104 estimates the posture, for example, an inclination, of the information processing apparatus 1 on the basis of information from the acceleration sensor 121, gyro sensor 122, GPS 123 and so forth and calculates a relative posture change amount with reference to predetermined time t=0. The acceleration sensor 121, gyro sensor 122, GPS 123 and so forth configure the nine-axis sensor 14 or the position measurement section 16 (both depicted in FIG. 3).

The relative position calculation section 103 calculates a relative sound source position on the basis of the sound image position at time t from the key frame interpolation section 101, the current position of the sound image from the sound image position holding section 102 and the posture information of the information processing apparatus 1 from the posture change amount calculation section 104 and supplies a result of the calculation to the sound image localization sound player 105.

The key frame interpolation section 101, relative position calculation section 103 and posture change amount calculation section 104 configure the state-behavior detection section 10*a*, relative position calculation section 10*d* and sound image localization section 10*e* of the control section 10 depicted in FIG. 3. The sound image position holding section 102 is made the storage section 17 (FIG. 3) and is configured such that it holds and updates the sound image position at the present point of time into and in the storage section 17.

The sound image localization sound player 105 reads in a sound file stored in the sound file storage section 124 and processes a sound signal or controls reproduction of the processed sound signal such that sound sounds as if the sound were emitted from a predetermined relative position.

The sound image localization sound player 105 can be made the sound output controlling section 10*f* of the control section 10 of FIG. 3. Further, the sound file storage section 124 can be made the storage section 17 (FIG. 3) and can be configured such that a sound file stored in the storage section 17 is read out.

Sound is reproduced by the speaker 125 under the control of the sound image localization sound player 105. The speaker 125 corresponds, in the configuration of the information processing apparatus 1 in FIG. 3, to the speaker 15.

The node information analysis section 106 analyzes information in a node supplied thereto and controls the components in the control section 10 (in this case, components that mainly process sound).

<Operation of Control Section>

According to the information processing apparatus 1 (control section 10) having such a configuration as described above, the lines A and the lines B can be reproduced as described above. Operation of the control section 10 depicted in FIG. 20 that performs such processes as described above is described with reference to flow charts of FIGS. 21 and 22.

Figure 21:
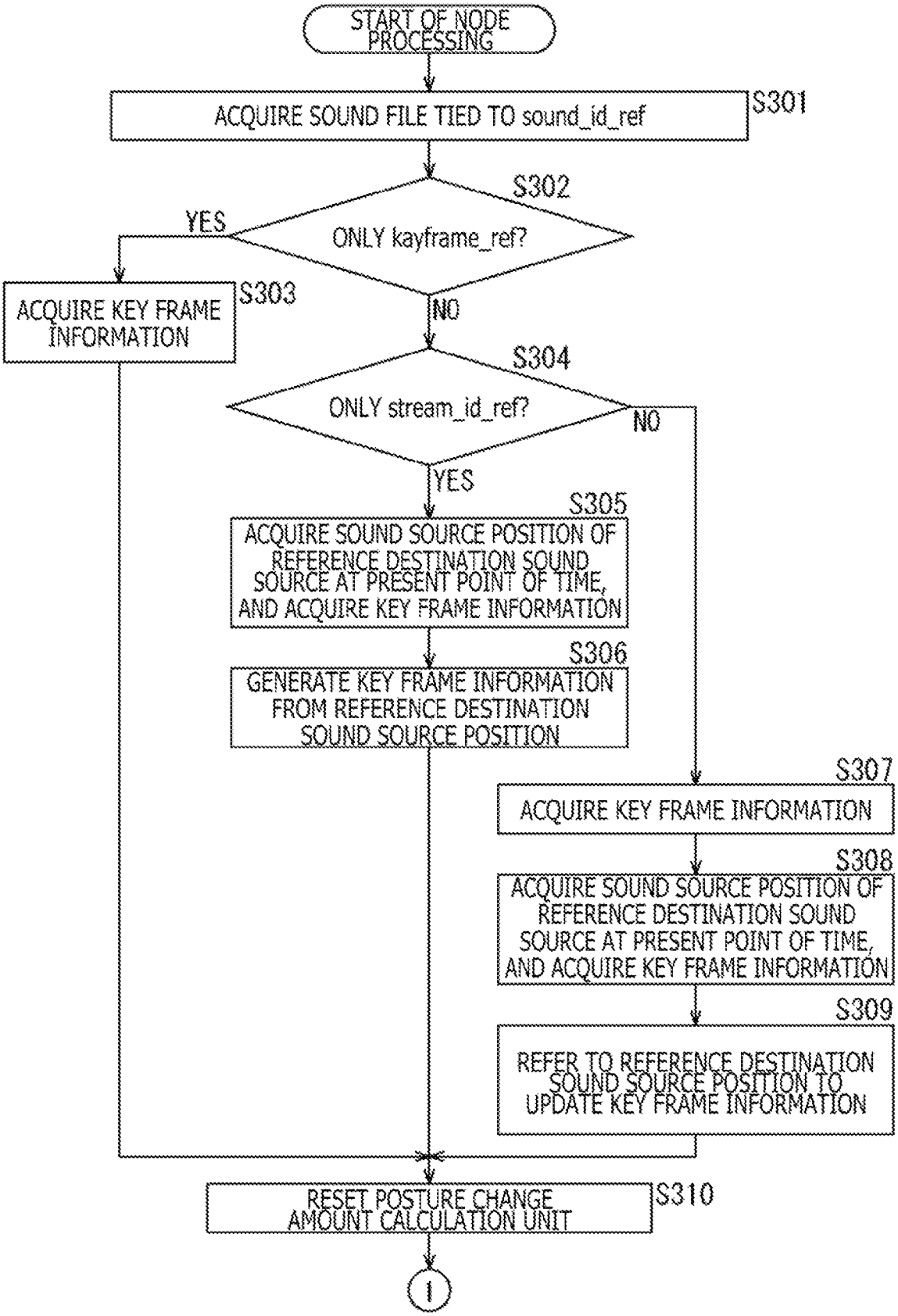
FIG. 21 is a flow chart illustrating operation of the control section.
Figure 22:
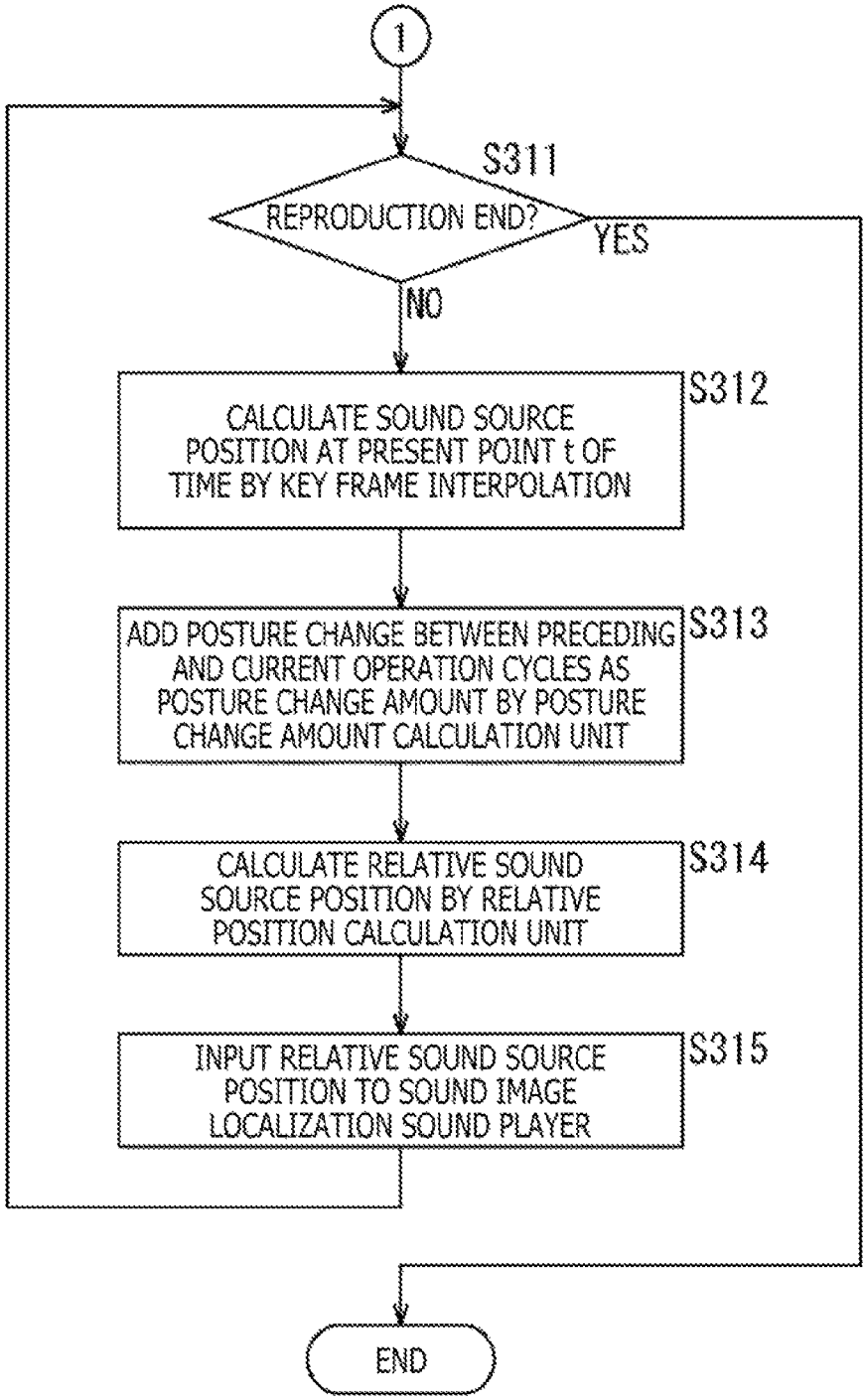
FIG. 22 is a flow chart illustrating operation of the control section.

The processes of the flow charts depicted in FIGS. 21 and 22 are processes that are started when processing of a predetermined node is started, in other words, when the processing target transits from a node during process to a next node. Further, a case in which the node determined as a processing target here is a node that is to reproduce sound is described as an example.

At step S301, the value of the parameter "sound id ref" included in "DirectionalSoundElement" of the node determined as a processing target is referred to, and a sound file based on "sound id ref" is acquired from the sound file storage section 124 and supplied to the sound image localization sound player 105.

At step S302, the node information analysis section 106 decides whether or not "DirectionalSoundElement" of the node of the processing target is a node in which only "keyframe ref" is designated.

In a case where it is decided at step S302 that "DirectionalSoundElement" of the node of the processing target is a node in which only "keyframe ref" is designated, the processing is advanced to step S303.

At step S303, key frame information is acquired. The flow of processing from step S302 to step S303 is the flow described hereinabove with reference to FIG. 17, and since details of the flow are described already, descriptions of the same is omitted here.

On the other hand, in a case where it is decided at step S302 that "DirectionalSoundElement" of the node of the processing target is not a node in which only "keyframe ref" is designated, the processing advances to step S304.

At step S304, the node information analysis section 106 is decided whether or not "DirectionalSoundElement" of the node of the processing target is a node in which only "stream id ref" is designated. In a case where it is decided at step S304 that "DirectionalSoundElement" of the node of the processing target is a node in which only "stream id ref" is designated, the processing is advanced to step S305.

At step S305, a sound source position of the sound source of the reference designation at the present point of time is acquired and key frame information is acquired. The relative position calculation section 103 acquires a sound source position of the sound source at the present point of time from the sound image position holding section 102 and acquires key frame information from the key frame interpolation section 101.

At step S306, the relative position calculation section 103 generates key frame information from the reference destination sound source position.

The flow of processes from step S304 to step S306 is the flow described hereinabove with reference to FIG. 18, and since details of the flow are described hereinabove, description of them is omitted here.

On the other hand, in a case where it is decided at step S304 that "DirectionalSoundElement" of the node of the processing target is not a node in which only "stream id ref" is designated, the processing is advanced to step S307.

The processing comes to step S307 when it is decided that "DirectionalSoundElement" is a node in which "keyframe ref" and "stream id ref" are designated. Therefore, the processing is advanced in such a manner as described with reference to FIG. 19.

At step S307, key frame information is acquired. The process at step S307 is performed similarly to the process at step S303 and is a process that is performed when "DirectionalSoundElement" designates "keyframe ref."

At step S308, the sound image position of the sound source of the reference destination at the present point of time is acquired and key frame information is acquired. The process at step S308 is performed similarly to the process at step S305 and is a process that is performed when "DirectionalSoundElement" designates "stream id ref."

At step S309, the key frame information is updated by referring to the reference destination sound source position. Although the key frame information has been acquired by referring to "keyframe ref," the acquired key frame information is updated with a sound source position referred to by "stream id ref" or the like.

The flow of processes from step S307 to step S309 is the flow described hereinabove with reference to FIG. 19, and since details of the flow are described already, description of them is omitted here.

At step S310, the posture change amount calculation section 104 is reset. Then, the processing is advanced to step S311 (FIG. 22). At step S311, it is decided whether or not the reproduction of sound comes to an end.

In a case where it is decided at step S311 that reproduction of sound does not come to an end, the processing advances to step S312. At step S312, the sound image position at the present point of time is calculated by key frame interpolation. At step S313, the posture change amount calculation section 104 calculates a posture change amount in the present operation cycle by adding the posture change during a period from the posture in the preceding operation cycle to the posture in the current operation cycle as a posture change amount to the posture change amount in the preceding operation cycle.

At step S314, the relative position calculation section 103 calculates a relative sound source position. The relative position calculation section 103 calculates the relative position of the virtual character 20 to the user A (information processing apparatus 1) in response to the sound source position calculated at step S312 and the posture change amount calculated at step S313.

At step S315, the sound image localization sound player 108 receives, as an input thereto, the relative position calculated by the relative position calculation section 103. The sound image localization sound player 108 performs control for outputting sound based on the sound file (part of the sound file) acquired at step S301 to the inputted relative position using the speaker 125.

After the process at step S315 ends, the processing is returned to step S311 to repeat the processes beginning with that at step S311. In a case where it is decided at step S311 that reproduction comes to an end, the processes of the flow charts depicted in FIGS. 21 and 22 are ended.

By execution of the processes at step S311 to step S315, processing of sound image animation based on the key frame is executed as described, for example, with reference to FIG. 15.

According to the present technique, since sound image animation can be provided to a user, in other words, since processing that can provide a user with such a sense that a virtual character is moving around the user can be executed, the entertainment to be provided in sound to the user can be enjoyed better.

Further, since the user can enjoy entertainments provided by the information processing apparatus 1, the period of time during which, for example, the user goes out with the information processing apparatus 1 mounted thereon or searches in the town on the basis of information provided from the information processing apparatus 1 can be increased.

Further, when sound image animation is provided, it is possible to make the position of a virtual character coincide with the position intended by the creator. In particular, when the lines B are reproduced after the lines A as in the embodiment described above, it is possible to perform reproduction of the lines B after the lines A while the relative position of the virtual character to the user is maintained.

Further, it is possible to perform reproduction of the lines B after the lines A while the absolute positions of the user and the virtual character (relative position of the virtual character to the user in the real space) are maintained.

Furthermore, also it is possible to start, upon reproduction of the lines B, reproduction from a position of the virtual character intended by the creator and execute reproduction of the lines B while a movement of the virtual character intended by the creator is regenerated.

In this manner, it is possible to make the position of the sound image coincide with the position intended by the creator and increase the degree of freedom in setting the position of the sound image.

It is to be noted that, although the embodiment described above is described taking the information processing apparatus 1, by which only sound is provided to the user, as an example, also it is possible to apply the present disclosure to such an apparatus that provides audio and video (image), for example, to a head-mounted display of AR (Augmented Reality) or VR (Virtual Reality).

<Recording Medium>

While the series of processes described above can be executed by hardware, it may otherwise be executed by software. In a case where the series of processes is executed by software, a program that constructs the software is installed into a computer. The computer here may be a computer incorporated in hardware for exclusive use, a personal computer for universal use that can execute various functions by installing various programs into the personal computer or the like.

Figure 23:
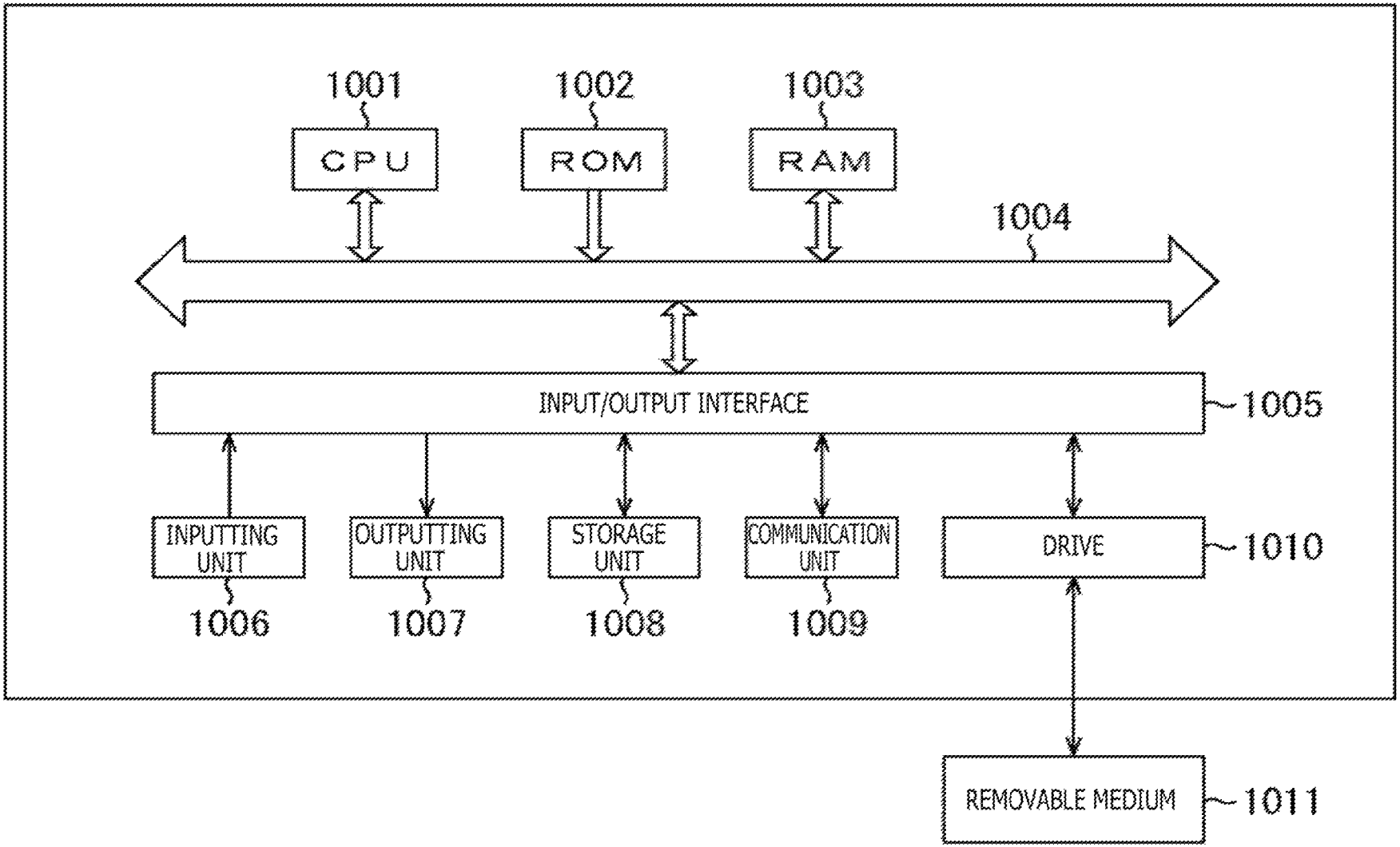
FIG. 23 is a view illustrating a recording medium.

FIG. 23 is a block diagram depicting an example of a hardware configuration of a computer that executes the series of processes described hereinabove in accordance with a program. In the computer, a CPU (Central Processing Unit) 1001, a ROM (Read Only Memory) 1002 and a RAM (Random Access Memory) 1003 are connected to one another by a bus 1004. Further, an input/output interface 1005 is connected to the bus 1004. An inputting section 1006, an outputting section 1007, a storage section 1008, a communication section 1009 and a drive 1010 are connected to the input/output interface 1005.

The inputting section 1006 includes a keyboard, a mouse, a microphone and so forth. The outputting section 1007 includes a display, a speaker and so forth. The storage section 1008 includes, for example, a hard disk, a nonvolatile memory or the like. The communication section 1009 includes, for example, a network interface or the like. The drive 1010 drives a removable medium 1011 such as a magnetic disk, an optical disk, a magneto-optical disk or a semiconductor memory.

In the computer configured in such a manner as described above, the CPU 1001 loads a program stored, for example, in the storage section 1008 into the RAM 1003 through the input/output interface 1005 and the bus 1004 and executes the program to perform the series of processes described above.

The program to be executed by the computer (CPU 1001) can be recorded on and provided as a removable medium 1011, for example, as a package medium or the like. Alternatively, the program can be provided through a wire or wireless transmission medium such as a local area network, the Internet or a digital satellite broadcast.

The computer can install the program into the storage section 1008 through the input/output interface 1005 by loading the removable medium 1011 into the drive 1010. Further, the program can be received by the communication section 1009 through a wired or wireless transmission medium and installed into the storage section 1008. Further, it is possible to install the program in advance in the ROM 1002 or the storage section 1008.

It is to be noted that the program to be executed by the computer may be a program by which the processes are performed in a time series in the order as described in the present specification or may be a program by which the processes are executed in parallel or executed individually at necessary timings such as when the process is called.

Further, in the present specification, the term system is used to represent an overall apparatus configured from a plurality of apparatus.

It is to be noted that the advantageous effects described in the present specification are exemplary to the last and are not restrictive, and other advantageous effects may be applicable.

It is to be noted that the embodiment of the present technique is not restricted to the embodiment described hereinabove and can be modified in various manners without departing from the subject matter of the present technique.

It is to be noted that the present technique can assume also the following configuration.

(1)

An information processing apparatus, including:

a calculation section that calculates a relative position of a sound source of a virtual object to a user, the virtual object allowing the user to perceive such that the virtual object exists in a real space by sound image localization, on the basis of a position of a sound image of the virtual object and a position of the user;

a sound image localization section that performs a sound signal process of the sound source such that the sound image is localized at the calculated localization position; and a sound image position holding section that holds the position of the sound image, in which when sound to be emitted from the virtual object is to be changed over, in a case where a position of a sound image of sound after the changeover is to be set to a position that takes over a position of the sound image of the sound before the changeover, the calculation section refers to the position of the sound image held in the sound image position holding section to calculate the position of the sound image.

(2)

The information processing apparatus according to (1) above, in which the position of the user is an amount of movement over which the user moves before and after the changeover of the sound, and the calculation section calculates the position of the sound source on the basis of the position of the sound image of the virtual object and the amount of movement.

(3)

The information processing apparatus according to (1) or (2) above, in which, where the calculation section sets, when the sound of the virtual object is changed over, a position at which utterance of the sound to which the sound is to be changed over is to be started is set to a position that takes over a position at which utterance of the sound before the changeover has been performed is performed, the calculation section calculates the position of the sound image by referring to the position of the sound image held in the sound image position holding section.

(4)

The information processing apparatus according to any one of (1) to (3) above, in which, in a case where a position of the sound image is to be set on a coordinate system fixed in the real space, the position of the sound image held in the sound image position holding section is referred to.

(5)

The information processing apparatus according to any one of (1) to (4) above, in which the calculation section calculates, where sound image position information relating to the position of the sound image of the virtual object is included in a node that is a processing unit in a sound reproduction process, a relative position of the sound source of the virtual object to the user on the basis of the sound image position information and the position of the user, and refers, in a case where an instruction to refer to different sound image position information is included in the node, to the position of the sound image held in the sound image holding section to generate the sound image position information and calculates a relative position of the sound source of the virtual object to the user on the basis of the generated sound source position information and the position of the user.

(6)

The information processing apparatus according to (5) above, in which, when the node that is a processing target transits to a different node, it is decided whether or not the sound image position information is included in the different node.

(7)

The information processing apparatus according to (3) above, in which the changeover of the sound occurs when a different process is to be performed in response to an instruction from the user.

(8)

The information processing apparatus according to (7) above, in which the node of a destination of the transition is changed in response to an instruction from the user.

(9)

The information processing apparatus according to (3) above, in which the virtual object is a virtual character, and the sound is lines of the virtual character and the sound before the changeover and the sound after the changeover are a series of lines of the virtual character.

(10)

The information processing apparatus according to any one of (1) to (9) above, further including:

a plurality of speakers that output sound for which sound signal processing for sound image localization is performed; and a housing that has the plurality of speakers incorporated therein and is capable of being mounted on the body of the user.

(11)

An information processing method, including the steps of:

calculating a relative position of a sound source of a virtual object to a user, the virtual object allowing the user to perceive such that the virtual object exists in a real space by sound image localization, on the basis of a position of a sound image of the virtual object and a position of the user;

performing a sound signal process of the sound source such that the sound image is localized at the calculated localization position; and updating the position of the held sound image, in which when sound to be emitted from the virtual object is to be changed over, in a case where a position of a sound image of sound after the changeover is to be set to a position that takes over a position of the sound image of the sound before the changeover, the held position of the sound image is referred to calculate the position of the sound image.

(12)

A program for causing a computer to execute a process including the steps of:

calculating a relative position of a sound source of a virtual object to a user, the virtual object allowing the user to perceive such that the virtual object exists in a real space by sound image localization, on the basis of a position of a sound image of the virtual object and a position of the user;

performing a sound signal process of the sound source such that the sound image is localized at the calculated localization position; and updating the position of the held sound image, in which when sound to be emitted from the virtual object is to be changed over, in a case where a position of a sound image of sound after the changeover is to be set to a position that takes over a position of the sound image of the sound before the changeover, the held position of the sound image is referred to calculate the position of the sound image.

REFERENCE SIGNS LIST

1 Information processing apparatus, 10 Control section, 10*a* State-behavior detection section, 10*b* Virtual character behavior determination section, 10*c* Scenario updating section, 10*d* Relative position calculation section, 10*e* Sound image localization section, 10*f* Sound output controlling section, 10*g* Reproduction history-feedback storage controlling section, 11 Communication section, 12 Microphone, 13 Camera, 14 Nine-axis sensor, 15 Speaker, 16 Position measurement section, 17 Storage section, 20 Virtual character, 101 Key frame interpolation section, 102 Sound image position holding section, 103 Relative position calculation section, 104 Posture change amount calculation section, 105 Sound image localization sound player, 106 Node information analysis section

The invention claimed is:

1. An information processing apparatus, comprising:

circuitry configured to calculate a relative position of a sound source of a virtual object to a user, the virtual object allowing the user to perceive such that the virtual object exists in a real space by sound image localization, on a basis of a position of a sound image of the virtual object and a position of the user, perform a sound signal process of the sound source such that the sound image is localized at the calculated localization position, hold the position of the sound image, wherein under a condition sound to be emitted from the virtual object is to be changed over, in a case where a position of a sound image of sound after the changeover is to be set to a position that takes over a position of the sound image of the sound before the changeover, the circuitry refers to a held position of the sound image to calculate the position of the sound image, calculate, where sound image position information relating to the position of the sound image of the virtual object is included in a node that is a processing node in a sound reproduction process, a relative position of the sound source of the virtual object to the user on a basis of the sound image position information and the position of the user, and refer in a case where an instruction to refer to different sound image position information is included in the processing node, to the held position of the sound image to generate the sound image position information and calculate a relative position of the sound source of the virtual object to the user on a basis of the generated sound source position information and the position of the user.

2. The information processing apparatus according to claim 1, wherein the position of the user is an amount of movement over which the user moves before and after the changeover of the sound, and the circuitry is configured to calculate the position of the sound source on a basis of the position of the sound image of the virtual object and the amount of movement.

3. The information processing apparatus according to claim 1, wherein where the circuitry is configured to set, when the sound of the virtual object is changed over, a position at which utterance of the sound to which the sound is to be changed over is to be started is set to a position that takes over a position at which utterance of the sound before the changeover has been performed is performed, the circuitry is configured to calculate the position of the sound image by referring to the held position of the sound image.

4. The information processing apparatus according to claim 3, wherein the changeover of the sound occurs when a different process is to be performed in response to an instruction from the user.

5. The information processing apparatus according to claim 4, wherein the node of a destination of the transition is changed in response to an instruction from the user.

6. The information processing apparatus according to claim 3, wherein the virtual object is a virtual character, and the sound is lines of the virtual character and the sound before the changeover and the sound after the changeover are a series of lines of the virtual character.

7. The information processing apparatus according to claim 1, wherein, in a case where a position of the sound image is to be set on a coordinate system fixed in the real space, the held position of the sound image is referred to.

8. The information processing apparatus according to claim 1, wherein when the node that is a processing target transits to a different node, it is decided whether or not the sound image position information is included in the different node.

9. The information processing apparatus according to claim 1, further comprising:

a plurality of speakers that output sound for which sound signal processing for sound image localization is performed; and a housing that has the plurality of speakers incorporated therein and is capable of being mounted on the body of the user.

10. An information processing method, comprising the steps of:

calculating a relative position of a sound source of a virtual object to a user, the virtual object allowing the user to perceive such that the virtual object exists in a real space by sound image localization, on a basis of a position of a sound image of the virtual object and a position of the user;

performing a sound signal process of the sound source such that the sound image is localized at the calculated localization position; and updating the position of a held sound image, wherein under a condition sound to be emitted from the virtual object is to be changed over, in a case where a position of a sound image of sound after the changeover is to be set to a position that takes over a position of the sound image of the sound before the changeover, the held position of the sound image is referred to calculate the position of the sound image, calculate, where sound image position information relating to the position of the sound image of the virtual object is included in a node that is a processing node in a sound reproduction process, a relative position of the sound source of the virtual object to the user on a basis of the sound image position information and the position of the user, and refer, in a case where an instruction to refer to different sound image position information is included in the processing node, to the held position of the sound image to generate the sound image position information and calculate a relative position of the sound source of the virtual object to the user on a basis of the generated sound source position information and the position of the user.

11. A non-transitory computer readable storage device having computer readable instructions stored therein that when executed by a computer cause the computer to perform a process, the process comprising:

calculating a relative position of a sound source of a virtual object to a user, the virtual object allowing a user to perceive such that the virtual object exists in a real space by sound image localization, on a basis of a position of a sound image of the virtual object and a position of the user;

performing a sound signal process of the sound source such e sound image is localized at the calculated localization position; and updating the position of the held sound image, wherein under a condition sound to be emitted from the virtual object is to be changed over, in a case where a position of a sound image of sound after the changeover is to be set to a position that takes over a position of the sound image of the sound before the changeover, the held position of the sound image is referred to calculate the position of the sound image, calculating, where sound image position information relating to the position of the sound image of the virtual object is included in a node that is a processing node in a sound reproduction process, a relative position of the sound source of the virtual object to the user on a basis of the sound image position information and the position of the user, and referring, in a case where an instruction to refer to different sound image position information is included in the processing node to the held position of the sound image to generate the sound image position information and calculating a relative position of the sound source of the virtual object to the user on a basis of the generated sound source position information and the position of the user.

* * * * *